US010168631B2

(12) United States Patent
Haruki et al.

(10) Patent No.: US 10,168,631 B2
(45) Date of Patent: Jan. 1, 2019

(54) ELECTROSTATIC IMAGE DEVELOPING TONER AND PRODUCTION METHOD OF ELECTROSTATIC IMAGE DEVELOPING TONER

(71) Applicant: Konica Minolta, Inc., Tokyo (JP)

(72) Inventors: Hidehito Haruki, Asaka (JP); Kouji Sugama, Musashino (JP); Noboru Ueda, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/786,981

(22) Filed: Oct. 18, 2017

(65) Prior Publication Data

US 2018/0120719 A1 May 3, 2018

(30) Foreign Application Priority Data

Nov. 1, 2016 (JP) ..... 2016-214114

(51) Int. Cl.

| | |
|---|---|
| ***G03G 9/087*** | (2006.01) |
| ***G03G 9/08*** | (2006.01) |
| ***G03G 9/093*** | (2006.01) |

(52) U.S. Cl.

CPC ..... *G03G 9/0827* (2013.01); *G03G 9/0823* (2013.01); *G03G 9/08755* (2013.01); *G03G 9/08782* (2013.01); *G03G 9/08795* (2013.01); *G03G 9/08797* (2013.01); *G03G 9/09314* (2013.01); *G03G 9/09364* (2013.01); *G03G 9/09371* (2013.01)

(58) Field of Classification Search

CPC . G03G 9/093; G03G 9/09307; G03G 9/09321

See application file for complete search history.

(56) References Cited

U.S. PATENT DOCUMENTS

| | | | | |
|---|---|---|---|---|
| 2014/0287354 | A1* | 9/2014 | Kawamura | G03G 9/0825 430/109.3 |
| 2014/0349228 | A1* | 11/2014 | Kadonome | G03G 9/0819 430/108.3 |
| 2015/0072285 | A1* | 3/2015 | Furukawa | G03G 9/0827 430/109.3 |

FOREIGN PATENT DOCUMENTS

| | | |
|---|---|---|
| JP | 2008040319 A | 2/2008 |
| JP | 2014002309 A | 1/2014 |

* cited by examiner

*Primary Examiner* — Peter L Vajda

(74) *Attorney, Agent, or Firm* — Lucas & Mercanti, LLP

(57) ABSTRACT

An object of the present invention is to provide an electrostatic image developing toner containing toner mother particles, wherein the toner mother particle is formed by being provided with a plurality of convex portions on a toner mother particle precursor; the toner mother particle precursor contains a vinyl resin, a crystalline resin, and a mold release agent; the convex portion is formed with a hybrid amorphous polyester resin which is formed with a vinyl type polymerization segment and a polyester type polymerization segment both bonded together; and the hybrid amorphous polyester resin contains constituting units of a bisphenol A-propylene oxide adduct and a bisphenol A-ethylene oxide adduct.

7 Claims, 2 Drawing Sheets

ELECTROSTATIC IMAGE DEVELOPING TONER AND PRODUCTION METHOD OF ELECTROSTATIC IMAGE DEVELOPING TONER

Japanese Patent Application No. 2016-214114 filed on Nov. 1, 2016 with Japan Patent Office, including description, claims, drawings, and abstract, the entire disclosure is incorporated herein by reference in its entirety.

TECHNOLOGICAL FIELD

The present invention relates to an electrostatic image developing toner and a production method of the electrostatic image developing toner. More specifically, the present invention relates to an electrostatic image developing toner which is excellent in fixing property (fixability), thermal resistance, and fluidity; and possesses sufficient durability and sufficient fixing belt separation property, and the present invention relates to a production method of the electrostatic image developing toner.

BACKGROUND

In the past, it has been required to obtain a copying machine of achieving high speed and energy saving. It has been developed an electrostatic image developing toner (hereafter, it may be simply called as "a toner") excellent in low-temperature fixing property for that purpose. With respect to this kind of toner, it is required to decrease the melting point or the melt viscosity of the binder resin, and it was proposed a toner that improved low-temperature fixing property by adding a crystalline resin such as a crystalline polyester resin (refer to Patent document 1: JP-A 2008-40319, for example).

At this moment, it was also proposed to make toner mother particles to have a core-shell structure and to avoid the presence of the crystalline resin on the surface of the toner mother particles. However, due to the compatibility of the crystalline resin and the shell, there were produced deterioration of thermal storage property, and deterioration of toner fluidity caused by increased adhering property. Further, by uniformly forming a shell layer that is difficult to melt than the core particle, the wax became difficult to reach the toner surface. As a result, the fixing belt separation property of the thin paler became insufficient especially at high speed fixing.

On the other hand, from the viewpoint of cleaning property, developability, and transferability, it was proposed a technology of forming a convex portion on the surface of the toner mother particles by using a vinyl modified polyester resin (refer to Patent document 2: JP-A 2014-02309, for example). However, the property of the toner was insufficient as the toner containing the crystalline resin.

SUMMARY

The present invention has been made in consideration of the above problems and situation. An object of the present invention is to provide an electrostatic image developing toner which is excellent in fixability, thermal resistance, and fluidity, and possesses sufficient durability and sufficient fixing belt separation property, and to provide a production method of the same electrostatic image developing toner.

The present inventors have investigated the reasons of the above-described problems in order to solve the above-described object of the present invention. It was fond to provide an electrostatic image developing toner which is excellent in fixability, thermal resistance, and fluidity, and possesses sufficient durability and sufficient fixing belt separation property. It was fond to provide a production method of the same. A plurality of convex portions are formed on the surface of the toner mother particle precursor of the specific electrostatic image developing toner. Further, the resin constitution of the toner mother particle precursor and the convex portion were specified. By this the present invention has been achieved.

The above-described object of the present invention may be solved by the following embodiments.

1. An electrostatic image developing toner comprising toner mother particles, wherein the toner mother particle is formed by being provided with a plurality of convex portions on a toner mother particle precursor;

the toner mother particle precursor contains a vinyl resin, a crystalline resin, and a mold release agent;

the convex portion is formed with a hybrid amorphous polyester resin which is formed with a vinyl type polymerization segment and a polyester type polymerization segment both bonded together; and the hybrid amorphous polyester resin contains constituting units of a bisphenol A-propylene oxide adduct and a bisphenol A-ethylene oxide adduct.

2. The electrostatic image developing toner of the embodiment 1, wherein the crystalline resin is contained in the range of 3 to 20 mass % with respect to the total mass of resins in the toner mother particle.

3. The electrostatic image developing toner of the embodiments 1 or 2, wherein the convex portions have an average long side length in the range of 100 to 300 nm.

4. The electrostatic image developing toner of any one of the embodiments 1 to 3, wherein the convex portions have an average distance on a surface of the toner mother particle precursor in the range of 20 to 100 nm.

5. The electrostatic image developing toner of any one of the embodiments 1 to 4, wherein the crystalline resin is encapsulated in the toner mother particle precursor, and the crystalline resin is not exposed to a surface of the toner mother particle precursor and a surface of the toner mother particle.

6. The electrostatic image developing toner of any one of the embodiments 1 to 5, wherein the hybrid amorphous polyester resin contains the vinyl type polymerization segment in the range of 5 to 30 mass %.

7. A method of producing the electrostatic image developing toner of any one of the embodiments 1 to 6, the method comprising the steps of:

making the toner mother particle precursor to have an average degree of circularity of 0.890 or more; and forming the convex portion by adhering the hybrid amorphous polyester resin on a surface of the toner mother particle precursor.

By any one of the above-described embodiments of the present invention, it is possible to provide an electrostatic image developing toner which is excellent in fixability, thermal resistance, and fluidity, and possesses sufficient durability and sufficient fixing belt separation property, and to provide a production method of the same electrostatic image developing toner.

A formation mechanism or an action mechanism of the effects of the present invention is not clearly identified, but it is supposed as follows.

As illustrated in FIG. 1, in the present invention, a crystalline resin 101*b* is included in a toner mother particle precursor 101 composed of a vinyl resin 101*a*; and as a resin that constitutes a convex portion 12, it is used a hybrid amorphous polyester resin in which a vinyl type polymerization segment 102*a* and a polyester type polymerization segment 102*b* are bonded together. In the present invention, the toner particle does not have a usual core-shell structure that completely covers a core particle with a shell, but a surface of the toner mother particle precursor has convex portions intermittently. The surface of the toner mother particle precursor has a convex structure. The shell layer does not uniformly cover the core particle, as is the case of usual core-shell structure. Instead, by making an intermittent convex shape, it is possible to achieve the structure of not impeding bleeding of wax while keeping thermal resistance. The toner is excellent in fixing belt separation property.

However, the crystalline resin is exposed on the surface of the toner mother particle precursor by merely making the convex portions to be intermittent. The thermal storage property and fluidity were not satisfactory.

Therefore, it was investigated a resin for forming a convex portion. It was achieved in decreasing the existing ration of the crystalline resin on the surface of the toner mother particle precursor by incorporating a bisphenol A-propylene oxide adduct and a bisphenol A-ethylene oxide adduct in the constituting units of the hybrid amorphous polyester resin. As a result, thermal resistance and fluidity of the toner were improved. It is assumed that the vinyl resin segment having the same resin as the toner mother particle resin tends to be orientated to the inside, and the polyester resin segment having the different resin as the toner mother particle resin tends to be orientated to the outside. This will reduce an influence on the dispersibility of the crystalline resin. In addition, by the compatibility of the hybrid amorphous polyester resin with the vinyl resin, the convex portion is hardly detached from the toner mother particle precursor. This will secure fixability, thermal resistance, fluidity, and durability.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
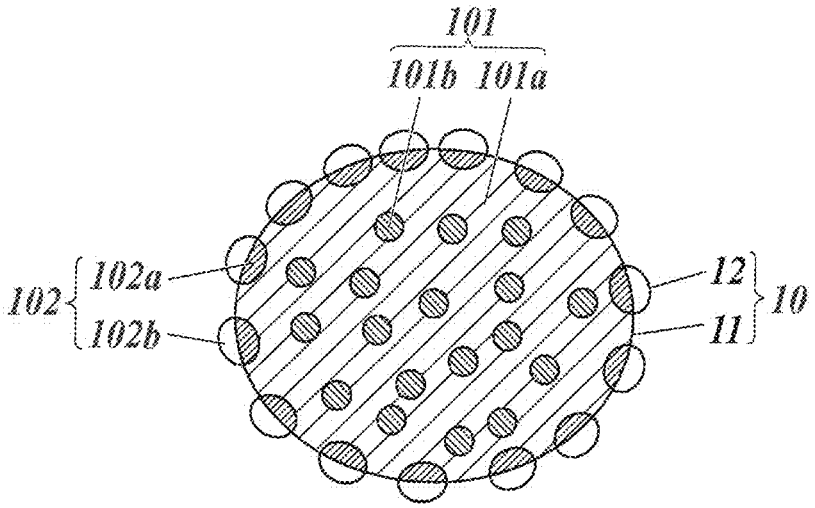
FIG. 1 is a schematic drawing of a toner mother particle relating to the present invention.

Hereinafter, one or more embodiments of the present invention will be described with reference to the drawings. However, the scope of the invention is not limited to the disclosed embodiments.

An electrostatic image developing toner of the present invention is a toner containing toner mother particles. It is characterized in that: the toner mother particle is formed by providing a plurality of convex portions on a toner mother particle precursor; the toner mother particle precursor contains a vinyl resin, a crystalline resin, and a mold release agent; the convex portion is formed with a hybrid amorphous polyester resin which is formed with a vinyl type polymerization segment and a polyester type polymerization segment both bonded together; and the hybrid amorphous polyester resin contains constituting units of a bisphenol A-propylene oxide adduct and a bisphenol A-ethylene oxide adduct. The above-described technical feature is common to the inventions relating to the embodiments of the present invention.

As one of the preferred embodiment of the present invention, it is preferable that the crystalline resin is contained in the range of 3 to 20 mass % with respect to the total mass of resins in the toner mother particle from the viewpoint of obtaining an effect of the present invention. By this embodiment it is possible to obtain a toner excellent in low-temperature fixability, and having improved thermal resistance and transferability.

It is preferable that the convex portions have an average long side length in the range of 100 to 300 nm from the viewpoint of not impeding fluidity and low-temperature fixability.

It is preferable that the convex portions have an average distance on a surface of the toner mother particle precursor in the range of 20 to 100 nm from the viewpoint of not impeding bleeding of the mold release agent during the fixing.

It is preferable that the crystalline resin is encapsulated in the toner mother particle precursor, and the crystalline resin is not exposed to a surface of the toner mother particle precursor and a surface of the toner mother particle from the viewpoint of obtaining sufficient thermal resistance and sufficient fluidity.

It is preferable that the hybrid amorphous polyester resin contains the vinyl type polymerization segment in the range of 5 to 30 mass % from the viewpoint of preventing detachment of the convex portion from the surface of the toner mother particle precursor, and to improve durability. And this will prevent exposure of the crystalline resin on the surface of the toner mother particle precursor and enables to achieve sufficient thermal resistance and sufficient fluidity.

A method of producing an electrostatic image developing toner of the present invention is characterized in making the toner mother particle precursor to have an average degree of circularity of 0.890 or more; and forming the convex portion by adhering the hybrid amorphous polyester resin on a surface of the toner mother particle precursor. By making the toner mother particle precursor to have an average degree of circularity of 0.890 or more, it is possible to form a required intermittent convex shape. Through the space between the convex portions, the mold release agent will be easily bled out. Consequently, the toner has excellent fixing belt separation property without impeding bleeding of the mold release agent. Further, since it is possible to prevent exposure of the crystalline resin on the surface of the toner mother particle precursor and the surface of the toner mother particle, it may be obtained sufficient thermal resistance and sufficient fluidity.

The present invention and the constitution elements thereof, as well as configurations and embodiments, will be detailed in the following. In the present description, when two figures are used to indicate a range of value before and after "to", these figures are included in the range as a lowest limit value and an upper limit value.

[General Outline of Electrostatic Image Developing Toner]

An electrostatic image developing toner of the present invention (hereafter, it may be simply called as "a toner") contains toner mother particles. The toner mother particle is formed by providing a plurality of convex portions on a toner mother particle precursor. Further, the toner mother particle precursor contains a vinyl resin, a crystalline resin, and a mold release agent, and the convex portion is formed with a hybrid amorphous polyester resin which is formed with a vinyl type polymerization segment and a polyester type polymerization segment both bonded together. Further, the hybrid amorphous polyester resin contains as constituting units: a bisphenol A-propylene oxide adduct; and a bisphenol A-ethylene oxide adduct.

In the present invention, when an external additive is added to a toner mother particle, it is called as a toner particle. An assembly of toner particles is called as "a toner". Although the toner mother particles may be generally used as they are, in the present invention, the toner mother particle added with an external additive are used as toner particles.

Figure 2:
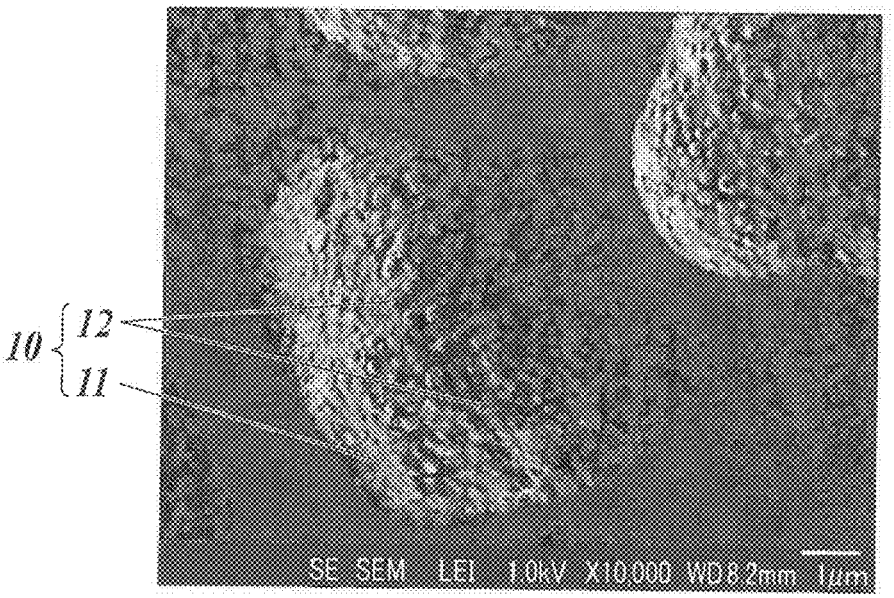
FIG. 2 is a SEM image of a toner mother particle relating to the present invention.

As illustrated in FIG. 1 and FIG. 2, a toner mother particle 10 related to the present invention has a toner mother particle precursor 11 and a plurality of convex portions 12 formed on a surface of the toner mother particle precursor.

<Average Long Side Length of Convex Portions>

The convex portions preferably have an average long side length in the range of 100 to 300 nm.

Figure 3:
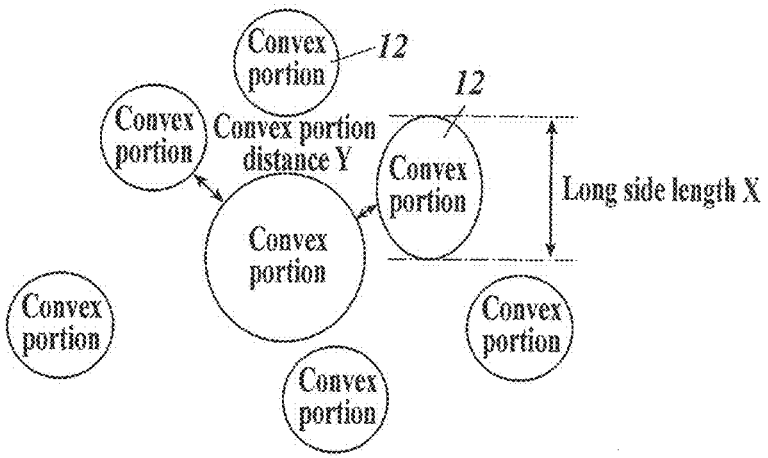
FIG. 3 is a diagram describing an average long side length and an average distance of convex portions of a toner mother particle relating to the present invention.

The average long side length of the convex portion of the present invention is obtained as follows. When scanning electron microscope (SEM) image data multiplied 10000 times is observed with a scanning electron microscope (SEM) (JSM-7401F, made by JOEL Co. Ltd.), the convex portion and the non-convex portion are confirmed by sight. An outline is drawn for each convex portion, and two parallel lines are drawn with the outline in between. The portion where the distance between the two parallel lines is largest is to be the long side of the convex portion. In the measurement, 20 convex portions which have a long side with a length of 30 nm or more are measured, and the average value of the above is determined to be the average long side length X of the convex portion of the present invention (refer to FIG. 3).

<Average Distance of Convex Portions>

It is preferable that an average distance of the convex portions on the surface of the toner mother particle precursor is in the range of 20 to 100 nm from the viewpoint of impeding bleeding of the mold release agent during the fixing.

The average distance of the convex portions is measured as follows. In the scanning electron microscope (SEM) image data multiplied 10000 times, the nearest four convex portions located from each convex portion are picked up. The average value of the shortest distance from the outer periphery of the target convex portion to the outer periphery of the picked up convex portions are calculated, and this value is defined as an distance. The measurement is done to 5 toner mother particles. 20 convex portions having a length of long side of 30 nm or more are measure. The average value thereof is determined to be an average distance Y of the convex portions of the present invention (refer to FIG. 3).

Here, the controlling methods of the average long side length and the average distance of the convex portions will be described.

In the step of producing a toner mother particle by forming a convex portions of a surface of a toner mother particle precursor, it will be progressed compatible mixing of styrene-acrylic resin segment (vinyl type polymerization segment) having a small difference of SP value (solubility parameter value). On the other hand, it will not be progressed compatible mixing of polyester resin segment (polyester type polymerization segment) having a large difference of SP value. As a result, the convex portion is formed which contains the polyester type polymerization segment on the surface of the toner mother particle precursor (refer to FIG. 1).

The controlling methods of the average long side length and the average distance of the convex portions are as follows: (a) constitution of resins; (b) particle diameter of resin for convex portion; (c) amount of resin for convex portion; (d) average degree of circularity of toner mother particle precursor before adding resin for convex portion; and (e) fusing time of resin for convex portion (average degree of circularity of toner mother particle).

(b) Particle Diameter of Resin for Convex Portion

The larger the particle diameter is, the longer the length of the convex portion is, and the wider the distance between the convex portions is. Specifically, the particle diameter of the hybrid amorphous polyester resin used for the resin of convex portion is preferably in the range of 50 to 300 nm.

(c) Amount of Resin for Convex Portion

The larger the amount of the resin for convex portion is, the longer the length of the convex portion is, and the narrower the distance between the convex portions is. Specifically, the content of the hybrid amorphous polyester resin used for the resin of convex portion is preferably in the range of 5 to 20 mass % with respect to the total mass of resins in the toner mother particle.

(d) Average Degree of Circularity of Toner Mother Particle Precursor Before Adding Resin for Convex Portion By increasing the average degree of circularity, the convex portion will be easily formed. Specifically, the average degree of circularity of the toner mother particle precursor is preferably 0.890 or more.

(e) Fusing Time of Resin for Convex Portion

The longer the fusion time, the larger the difference between the average degree of circularity of the toner mother particle and the average degree of circularity of the toner mother particle precursor before adding the resin for convex portion is. The length of the convex portion becomes short. Specifically, the fusing time of the resin for convex portion is preferably in the range of 10 to 180 minutes, more preferably in the range of 30 to 120 minutes.

<Average Height of Convex Portions>

An average height of convex portions is preferably in the range of 40 to 120 nm from the viewpoint of securing the thermal resistance, preventing inhibition of the effect of the external additive, and stabilizing charging property.

The average height of convex portions is measured as follows. In the scanning electron microscope (SEM) image data multiplied 10000 times, 20 convex portions which have a long side with a length of 30 nm or more are picked up among 100 pieces of toner mother particles. From the surface of the toner mother particle and the peak of the convex portion are held with two parallel lines. The portion where the distance between the two parallel lines is largest is to be the height of the convex portion. An average value thereof is determined to be an average height of the convex portions.

<Average Distribution Density of Convex Portions>

An average distribution density of the convex portions on the surface of the toner mother particle precursor is preferably in the range of 8 to 25 pieces/$\mu m^2$ from the viewpoint of achieving a good balance between thermal resistance and fixing belt separation property.

An average distribution density of the convex portions is measured as follows. In the scanning electron microscope (SEM) image data multiplied 10000 times, 10 arbitral toner mother particles are picked up. The number of the convex portions which have a long side with a length of 30 nm or more per 1 $\mu m^2$ are counted. An average value thereof is decided to be an average distribution density of the convex portions of the present invention.

In addition, when the convex portion is in the boundary line, it is not counted as the number of the convex portions.

[Toner Mother Particle Precursor]

As illustrated in FIG. 1, a toner mother particle precursor 11 relating to the present invention contains: a vinyl resin 101*a*; a crystalline resin 101*b*; and a mold release agent (not illustrated). Hereafter, the binder resins (the vinyl resin 101*a* and the crystalline resin 101*b*) that constitute the toner mother particle precursor 11 may be called as a toner mother particle precursor resin (101) (or a resin (101)).

[Resin for Toner Mother Particle Precursor]

<Vinyl Resin>

A vinyl resin relating to the present invention is a resin obtained by polymerization of a vinyl type monomer. Specific examples of an amorphous vinyl resin are an acrylic resin and a styrene-acrylic copolymer resin. Among them, preferable is a styrene-acrylic type resin in which a styrene type monomer and an acrylic type monomer are polymerized. With this, it is possible to obtain the effect of suppressing generation of filming.

As the polymerizable monomer used in the styrene-acrylic type resin, preferable is an aromatic type vinyl monomer and a (meth)acrylic acid ester type monomer, and includes ethylenic unsaturated bonding body in which radical polymerization is possible. Examples thereof are: styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene. These aromatic type vinyl monomers may be used alone or they may be used in combination of two or more kinds.

Examples of a (meth)acrylic acid ester type monomer are: methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethylaminoethyl methacrylate, and diethylaminoethyl methacrylate. These (meth)acrylic acid ester type monomers may be used alone or they may be used in combination of two or more kinds. Among them, it is preferable to use a styrene type monomer with an acrylic acid ester type monomer or a methacrylic acid ester type monomer.

As the polymerizable monomer, the third vinyl type monomer may be used. The following may be used as the third vinyl type monomer, for example, an acid monomer such as acrylic acid, methacrylic acid, maleic acid anhydride, and vinyl acetic acid, acrylamide, methacrylamide, acrylonitrile, ethylene, propylene, butylene vinyl chloride, N-vinyl pyrrolidone, and butadiene.

As the polymerizable monomer, a multifunctional vinyl type monomer may also be used. The following may be used as the multifunctional vinyl type monomer, for example, diacrylate such as ethylene glycol, propylene glycol, butylene glycol, and hexylene glycol, divinylbenzene, pentaerythritol, dimethacrylate and trimethacrylate with alcohol of tertiary or more such as trimethylolpropane. The copolymerization ratio of multifunctional vinyl type monomer with respect to the entire polymerizable monomer is usually within the range of 0.001 to 5 mass %, preferably within the range of 0.003 to 2 mass %, and more preferably within the range of 0.01 to 1 mass %. By using the multifunctional vinyl type monomer, an insoluble gel component is generated in tetrahydrofuran, but the percentage that the gel component accounts for with respect to the entire monomer is usually equal to or less than 40 mass %, and preferably equal to or less than 20 mass %.

<Crystalline Resin>

A content of a crystalline resin contained in the toner mother particle precursor is preferably in the range of 3 to 20 mass % with respect to the total resin mass contained in the toner mother particle. Particularly preferable content is in the range of 5 to 15 mass %. When it is 3 mass % or more, good fixability may be obtained, and when it is 20 mass % or less, it may be prevented decrease of thermal resistance caused by too much amount of presence on the surface of the toner mother particle. It may be prevented transfer defect caused by decrease of electric resistance.

The crystalline resin relating to the present invention is preferably encapsulated in the toner mother particle precursor, and it is preferable that the crystalline resin is not exposed to a surface of the toner mother particle precursor and a surface of the toner mother particle.

Specifically, the crystalline resin has the following properties. When an absorption spectrum is measured with a total reflection method (ATR method) using a Fourier transform infrared spectroscopic analyzer, the absorption wave number has an absorption maximum peak in the range of 690-710 $cm^{-1}$ (P1) and 1190-1220 $cm^{-1}$ (P2), and the ratio of (P2/P1) obtained by the absorption maximum peak height (P1) in 690-710 $cm^{-1}$, and the absorption maximum peak height (P2) in 1190-1220 $cm^{-1}$ is preferably in the range of 0.02 to 0.2, more preferably in the range of 0.02 to 0.1.

By making the ratio P2/P1 to be in the range of 0.02 to 0.2, it may be prevented exposure of the crystalline polyester resin to the surface of the toner mother particle precursor and to the surface of the toner mother particle. It may be obtained sufficient thermal resistance and sufficient fluidity. Further, by making the ratio P2/P1 to be less than 0.1, the fluidity will be further increased.

As a method of making the ratio P2/P1 to be 0.20 or less, the following are cited. One of them is to control the constitution of the convex portion resin and the fusing time of the convex portion resin, and the other is to control the cooling speed (in the cooling step) of the aqueous dispersion liquid of the toner mother particles obtained by aggregating and fusing the vinyl resin particles and crystalline resin particles during production of the toner. It is preferable to control the cooling speed in the range of 10 to 30° C./min, since the recrystallization of the crystalline resin will be inhibited, and the ratio P2/P1 will be decreased.

(Measurement Method of Peak Height Ratio)

The ratio (P2/P1) of the absorption maximum peak height (P1) in the range of 690-710 $cm^{-1}$ and the absorption maximum peak height (P2) in the range of 1190-1220 $cm^{-1}$ may be obtained from a peak intensity ratio in an absorption spectrum with a total reflection method (ATR method) using a Fourier transform infrared spectroscopic analyzer (for examples, Nicolet 380, made by Themo Fisher Co. Ltd.).

First, 0.2 g of toner mother particles was placed in a pellet molder (SSP-10A, made by Shimadzu Co. Ltd.) as a sample. It was pressed with 400 kgf for one minute to prepare a pellet having a diameter of 10 mm.

The ART measurement was done with a diamond crystal under the condition of resolution of 4 $cm^{-1}$, with accumulation times of 32. The obtained ART spectrum was corrected with a correction method of the apparatus, and the value was determined from the peak intensity ratio in the ART corrected spectrum.

The absorption maximum peak height (P1) in the range of 690-710 $cm^{-1}$ is derived from the styrene-acrylic resin, and it is defined as follows.

In the absorption wave number range of 690 to 710 $cm^{-1}$, there is a maximum rising peak point Mp1, which has a maximum absorbance, between a first decreasing peak point (hereafter, it is called as "first decreasing peak point Fp1") having a first smallest absorbance and a second decreasing peak point (hereafter, it is called as "second decreasing peak point Fp2") having a second smallest absorbance. The line connecting the first decreasing peak point Fp1 and the second decreasing peak point Fp2 is made to be a base line. A perpendicular line is drawn from the maximum rising peak point Mp1 to the horizontal axis. The absolute value of the difference between the absorbance at the cross point of the base line and the absorbance of the maximum rising peak point Mp1 is determined to be a height P1 of the maximum rising peak point Mp1.

The absorption maximum peak height (P2) in the range of 1190-1220 $cm^{-1}$ is derived from the crystalline polyester resin, and it is defined as follows.

In the absorption wave number range of 1190 to 1220 $cm^{-1}$, there is a maximum rising peak point, which has a maximum absorbance, between a first decreasing peak point (hereafter, it is called as "first decreasing peak point") having a first smallest absorbance and a second decreasing peak point (hereafter, it is called as "second decreasing peak point") having a second smallest absorbance. The line connecting the first decreasing peak point and the second decreasing peak point is made to be a base line. A perpendicular line is drawn from the maximum rising peak point to the horizontal axis. The absolute value of the difference between the absorbance at the cross point of the base line and the absorbance of the maximum rising peak point is determined to be a height P2 of the maximum rising peak point.

Figure 4:
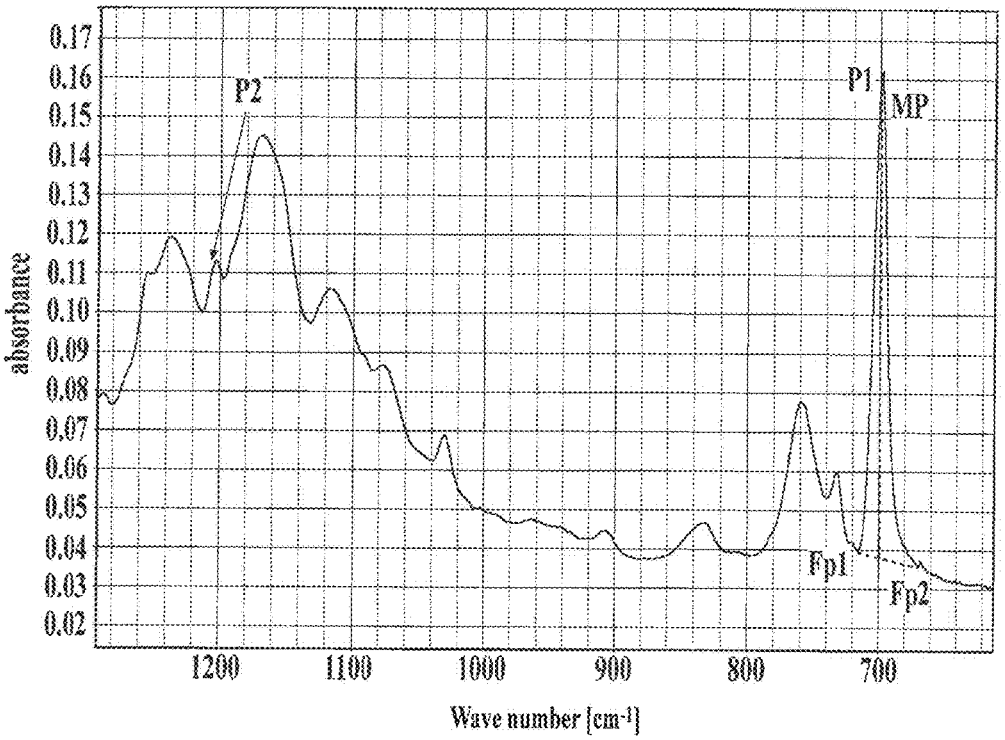
FIG. 4 is a diagram illustrating an example of absorption spectrum obtained by ATR method.

FIG. 4 illustrates an example of a spectrum obtained with an ART method.

The crystalline resin contained in the toner mother particle precursor of the present invention may be any known crystalline resin as long as it exhibits a crystalline property.

"To exhibit a crystalline property" indicates that the resin has a melting point, that is, the resin has a definite endothermic peak during increase of temperature in an endothermic curve obtained with DSC. "A definite endothermic peak" is a peak having a half bandwidth of 15° C. or less in the endothermic curve when the temperature is increased with an increase speed of 10° C./min.

From the viewpoint of obtaining excellent low-temperature fixability, it is preferable that the toner particle contains a crystalline polyester resin as a crystalline resin, and a content of the crystalline polyester resin in the toner particle is in the range of 5 to 30 mass %.

When the content is 5 mass % or more, it may be obtained sufficient low-temperature fixability, and when the content is 30 mass % or less, it may be prevented scattering of the toner caused by decrease of charging property.

(Crystalline Polyester Resin)

A crystalline polyester resin designates a resin having a crystalline property among polyester resins obtained through polymerization of a carboxylic acid monomer having 2 or more valence (polycarboxylic acid) and an alcohol having 2 or more valence (polyalcohol).

As a polycarboxylic acid monomer that may be used for production of crystalline polyester resin, the following are cited: a saturated aliphatic dicarboxylic acid such as oxalic acid, diatonic acid, succinic acid, adipic acid, sebacic acid, azelaic acid, n-dodecylsuccinic acid, 1,10-decanedicarboxylic acid (dodecanedioic acid), and 1,12-dodecanedicarboxylic acid (tetradecanedioic acid); an alicyclic dicarboxylic acid such as cyclohexane dicarboxylic acid; and a polycarboxylic acid having 3 or more valence such as trimellitic acid and pyromellitic acid/These may be used alone, or may be used in combination of two or more kinds.

As a polyalcohol monomer that may be used for production of crystalline polyester resin, the following are cited: aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, neopentyl glycol, and 1,4-butenediol; and a polyalcohol having 3 or more valence such as glycerin, pentaerythritol, trimethylolpropane, and sorbitol.

These may be used alone, or may be used in combination of two or more kinds.

<Glass Transition Temperature and Softening Temperature>

The resin for toner mother particle precursor preferably has a glass transition temperature (Tg) in the range of 40 to 60° C. Further, the resin for toner mother particle precursor preferably has a softening temperature in the range of 80 to 130° C.

(Measuring Method of Glass Transition Temperature (Tg))

The glass transition temperature of the resin for toner mother particle precursor is a value measured by the method (DSC method) defined by ASTM (American Society for Testing and Materials) D3418-82.

Specifically, 3.0 mg of a sample is weighed precisely to two digits after the decimal, the sample is sealed in an aluminum pan, and the sample is set in a sample holder of a differential scanning calorimeter "Diamond DSC" (manufactured by PerkinElmer, Inc.). An empty aluminum pan is used for reference, temperature is controlled by raising-lowering-raising at a measured temperature being within a range of 0 to 200° C., temperature raising speed being 10° C. per minute, temperature lowering speed being 10° C., and the analysis is performed based on data when the temperature is raised the second time. The glass transition temperature is to be the value of the crossing point between the extended line of the base line before the rising of the first endothermic peak and the tangent showing the maximum slope from the rising portion of the first endothermic peak to the top of the peak.

(Measuring Method of Softening Temperature (Tsp))

The softening temperature (Tsp) of the resin for toner mother particle precursor is measured by the following method.

First, under an environment of 20° C.±1° C., 50%±5% RH, 1.1 g of resin is placed in a petri dish and smoothed to be flat. After leaving the resin as is for 12 hours or more, pressure is applied for 30 seconds at a force of 3820 $kg/cm^2$ by a molder "SSP-10A" (manufactured by Shimadzu Corporation), and a cylinder shaped molded sample with a 1 cm diameter is made. Next, under the environment of 24° C.±5°

C., 50%±20% RH, using a flow tester "CFT-500D" (manufactured by Shimadzu Corporation) under the conditions of load 196 N (20 kgf), starting temperature 60° C., preheat time 300 seconds, temperature raising speed 6° C. per minute, the molded sample is pressed out from a hole of a cylinder shaped die (1 mm diameter×1 mm) using a piston with a diameter of 1 cm after finishing the preheating. The softening temperature of the resin is to be an offset method temperature $T_{offset}$ measured at a setting of 5 mm off set value with melting temperature measuring method of raising temperature method.

<Production Method of Resin for Toner Mother Particle Precursor>

The resin for toner mother particle precursor relating to the present invention is preferably prepared by emulsion polymerization. Emulsion polymerization may be achieved by dispersing and polymerizing in an aqueous medium polymerizable monomers such as styrene, and acrylic acid ester. A surfactant is preferably used to disperse the polymerizable monomers in the aqueous medium. A polymerization initiator or a chain transfer agent may be used for polymerization.

(Polymerization Initiator)

The polymerization initiators used in the polymerization of the resin for toner mother particle precursor are not limited and any well-known polymerization initiator may be used. Specifically, examples include the following, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-hydroperoxide petriphenylacetate, tert-butyl performate, tert-butyl peracetate, tert-butyl-perbenzoate, tert-butyl perphenylacetate, tert-butyl permethoxyacetate, and tert-butyl per-N-(3-toluyl)palmitate; and azo compounds such as 2,2'-azobis(2-aminodipropane)hydrochloride, 2,2'-azobis(2-aminodipropane)nitrate, 1,1'-azobis(1-methylbutyronitrile-3-sodium sulfonate), 4,4'-azobis-4-cyanovaleric acid, and poly(tetraethylene glycol-2,2'-azobisisobutyrate); and the like. The added amount of the polymerization initiator is different depending on the desired molecular weight and molecular weight distribution. Specifically, the polymerization initiator is added preferably within the range of 0.1 to 5.0 mass % with respect to the polymerizable monomer.

(Chain Transfer Agent)

In production of the resin for toner mother particle precursor relating to the present invention, the chain transfer agent may be added together with the polymerization monomer. The molecular weight of the polymer may be controlled by adding the chain transfer agent. In the above described step of polymerizing aromatic type vinyl monomer and a (meth)acrylic acid ester type monomer, it is possible to use a typically used chain transfer agent for the purpose of adjusting the molecular weight of the styrene-acrylic type polymer segment. The chain transfer agent is not limited and the following may be used, for example: alkyl mercaptan and mercapto fatty acid ester.

The added amount of the chain transfer agent is different depending on the desired molecular weight and molecular weight distribution. Specifically, the chain transfer agent is preferably added in the range of 0.1 to 5 mass % with respect to the polymerizable monomer.

(Surfactant)

When the emulsion polymerization method is used and the resin for toner mother particle precursor is dispersed in the aqueous medium and polymerized, a dispersion stabilizer is usually added to prevent aggregation of dispersed drops. Any well-known surfactant may be used as the dispersion stabilizer, and the dispersion stabilizer selected from a group of cationic surfactant, anionic surfactant, and non-ionic surfactant may be used. A combination of two or more of the above surfactants may be used. The dispersion stabilizer may be used in the dispersion liquid of colorant and offset preventing agent.

Specific examples of a cationic surfactant include: dodecyl ammonium bromide, dodecyl trimethyl ammonium bromide, dodecylpyridinium chloride, dodecylpyridinium bromide, and hexadecyl trimethyl ammonium bromide.

Specific examples of a non-ionic surfactant include, dodecyl polyoxy ethylene ether, hexadecyl polyoxy ethylene ether, nolylphenyl polyoxy ethylene ether, lauryl polyoxy ethylene ether, sorbitan monooleate polyoxy ethylene ether, styryl phenyl polyoxy ethylene ether, and monodecanoyl sucrose.

Specific examples of an anionic surfactant include, aliphatic type soap such as sodium stearate, sodium laurate, etc., sodium lauryl sulfate, sodium dodecyl benzene sulfonate, and polyoxy ethylene (2) sodium lauryl ether sulfate.

<Mold Release Agent>

As a mold release agent contained in the toner mother particle precursor of the present invention, wax may be added. Examples of wax are: hydrocarbon type wax group such as low molecular weight polyethylene wax, low molecular weight polypropylene wax, Fischer Tropsch wax, microcrystalline wax, paraffin wax; ester wax group such as carnauba wax, pentaerythritol behenate, behenyl behenate, and behenyl citrate. These may be used alone or they may be used in combination of two or more kinds.

From the viewpoint of reliably obtaining low-temperature fixing property and mold separating property of the toner, the melting temperature of the wax is preferably in the range of 50 to 95° C. The content ratio of the wax with respect to the entire mass of the resin for the toner mother particle precursor is preferably in the range of 2 to 20 mass %, more preferably in the range of 3 to 18 mass %, and even more preferably in the range of 4 to 15 mass %.

[Convex Portion]

As illustrated in FIG. 1, a convex portion 12 relating to the present invention is formed with a hybrid amorphous polyester resin which includes a vinyl type polymerization segment 102*a* and a polyester type polymerization segment 102*b* both bonded together. The hybrid amorphous polyester resin is characterized in containing constituting units of: a bisphenol A-propylene oxide adduct; and a bisphenol A-ethylene oxide adduct.

In the following, the resin (the hybrid amorphous polyester resin) constituting the convex portion is also called as a convex portion resin (102) (or a resin (102)).

[Convex Portion Resin]

<Hybrid Amorphous Polyester Resin>

A hybrid amorphous polyester resin rerating to the present invention is a resin in which a vinyl type polymerization segment composed of styrene-acrylic type polymer and a polyester type polymerization segment composed of an amorphous polyester resin are bonded through a bireactive monomer. The vinyl type polymerization segment is a polymer portion obtained by polymerizing an aromatic vinyl type monomer and a (meth)acrylic acid ester type monomer.

According to the present invention, preferably, the content ratio of the vinyl type polymerization segment in the hybrid amorphous polyester resin is in the range of 5 to 30 mass % with respect to the entire mass of the hybrid amorphous polyester resin, and especially preferable ratio is in the range of 10 to 10 mass %. In addition, it is preferable that the hybrid amorphous polyester resin contains the polyester type polymerization segment in the range of 95 to 50 mass %.

When the hybrid amorphous polyester resin contains the vinyl type polymerization segment in the range of 5 to 30 mass %, detachment of the convex portion will hardly occur, and durability will be increased. Further, it will hardly occur fusion of the convex portions during production of the toner. The crystalline resin will not be exposed to the surface of the toner mother particle precursor, and it may be obtained a sufficient effect of the convex portion.

The content ratio of the vinyl type polymerization segment in the hybrid amorphous polyester resin is specifically, the ratio of the mass of the aromatic type vinyl monomer and the meth(acrylic) acid ester type monomer which form the vinyl type polymerization segment with respect to the entire mass of the resin materials used to synthesize the hybrid amorphous polyester resin, in other words, the entire mass after adding the following, the polymerizable monomer which forms the non-modified polyester resin to become the polyester type polymerization segment, the aromatic type vinyl monomer and the (meth)acrylic acid ester type monomer to become the vinyl type polymerization segment and the bireactive monomer to bond the above.

Further, it is preferable that an unsaturated aliphatic dicarboxylic acid is used as a polycarboxylic acid monomer to form the polyester type polymerization segment of the hybrid amorphous polyester resin and a structural unit from the unsaturated aliphatic dicarboxylic acid is included in the polyester type polymerization segment. The unsaturated aliphatic dicarboxylic acid is a chain dicarboxylic acid including a vinylene group in the molecule. Here, the structure unit is a unit of a molecular structure from the monomer in the resin.

It is preferable that the content ratio of the structural unit from the unsaturated aliphatic dicarboxylic acid in the structural unit from the polycarboxylic acid monomer composing the polyester type polymerization segment (hereinafter, it is also referred to as "specific unsaturated dicarboxylic acid content ratio") is in the range of 18 to 75 mol %, more preferably in the range of 25 to 60 mol %, and especially preferably in the range of 30 to 60 mol %.

As the structural unit derived from the unsaturated aliphatic dicarboxylic acid, it is preferable that it is derived from the compound represented by the following Formula (A).

$$HOOC—(CR_1{=}CR_2)_n—COOH \qquad \text{Formula (A):}$$

(In the formula, $R_1$ and $R_2$ represent a hydrogen atom, a methyl group or an ethyl group, and $R_1$ and $R_2$ may be the same or different. Here, n is an integer of 1 or 2.)

Since the structural unit from the unsaturated aliphatic dicarboxylic acid is included, the hydrophilic nature of the polyester resin increases due to the carbon-carbon double bond. Therefore, when the toner particle is formed in the aqueous medium by the emulsion aggregation method, the effect that the polyester resin segment being oriented to the outside of the core particle, in other words, to the aqueous medium side, becomes large, and it becomes easier for the convex portion to be formed on the surface of the toner mother particle. According to the present invention, when the unsaturated aliphatic dicarboxylic acid represented by Formula (A) is used in the polymerization reaction, it is possible to use it in the anhydrous form.

A content of the hybrid amorphous polyester resin in the toner mother particles is preferably in the range of 5 to 20 mass % from the viewpoint of obtaining the effect of the convex portion without deteriorating the fixability.

<Glass Transition Temperature and Softening Temperature>

The hybrid amorphous polyester resin preferably has a glass transition temperature (Tg) in the range of 50 to 70° C. from the viewpoint of low-temperature fixability. More preferably, it is in the range of 50 to 65° C. Moreover, it is preferable that the hybrid amorphous polyester resin has a softening temperature in the range of 80 to 110° C.

(Measuring Method of Glass Transition Temperature (Tg))

The glass transition temperature of the hybrid amorphous polyester resin is a value measured by the method (DSC method) defined by ASTM (American Society for Testing and Materials) D3418-12el. It may be measured by the method similar to the method used for the resin for the toner mother particle precursor as described above.

(Measuring Method of Softening Point (Tsp))

The softening point of the hybrid amorphous polyester resin may be measured by the method similar to the method used for the resin for the toner mother particle precursor as described above.

<Production Method of Hybrid Amorphous Polyester Resin>

A well-known typical scheme may be used as a production method of hybrid amorphous polyester resin. The following four methods are representative methods.

(A) A method of forming vinyl type polymerization segment in which polyester type polymerization segment is polymerized in advance, a bireactive monomer is reacted in the polyester type polymerization segment and further the aromatic type vinyl monomer and (meth)acrylic acid ester type monomer for forming the vinyl type polymerization segment are reacted. In other words, a method in which the aromatic type vinyl monomer and the (meth)acrylic acid ester type monomer for forming the vinyl type polymerization segment is polymerized with the bireactive monomer including a group which can be reacted with the polycarboxylic acid monomer or polyalcohol monomer for forming the polyester type polymerization segment and a polymerizable unsaturated group and with the non-modified polyester resin.

(B) A method of forming polyester type polymerization segment in which vinyl type polymerization segment is polymerized in advance, a bireactive monomer is reacted in the vinyl type polymerization segment, and polycarboxylic acid monomer and polyalcohol monomer for forming the polyester type polymerization segment are reacted.

(C) A method of bonding the polyester type polymerization segment and the vinyl type polymerization segment where the polyester type polymerization segment and the vinyl type polymerization segment are each polymerized in advance and the bireactive monomer is reacted in the above.

(D) A method of bonding the polyester type polymerization segment and the vinyl type polymerization segment where the polyester type polymerization segment is polymerized in advance, and the vinyl type polymerizable monomer is added for polymerization in the polymerizable unsaturated group of the polyester type polymerization segment or the vinyl group in the vinyl type polymerization segment is reacted with the polymerizable unsaturated group of the polyester type polymerization segment.

Here, the bireactive monomer is a monomer including: a group which can be reacted with the polycarboxylic acid monomer or polyalcohol monomer for forming the polyester type polymerization segment of the hybrid amorphous polyester resin; and a polymerizable unsaturated group.

Specifically, the method of (A) includes the following steps.

(1) Mixing step in which the following are mixed, (i) non-modified polyester resin for forming the polyester type polymerization segment, (ii) aromatic type vinyl monomer and (meth)acrylic acid ester type monomer, and (iii) bireactive monomer.

(2) By going through a polymerizing step in which aromatic type vinyl monomer and the (meth)acrylic acid ester type monomer are polymerized in the presence of a bireactive monomer and a non-modified polyester resin, vinyl type polymerization segment may be formed in an end of the polyester type polymerization segment. In this case, the hydroxyl group of the end of the polyester type polymerization segment and the carboxy group of the bireactive monomer form an ester bonding. The vinyl group of the bireactive monomer and the vinyl group of the aromatic type vinyl monomer or the (meth)acrylic acid type monomer bond, and the vinyl type polymerization segment is bonded. Among the methods of synthesizing, the method (A) is most preferable.

Preferably, heating is performed in the mixing step described in the above noted (1). The heating temperature is to be a range where the non-modified polyester resin, the aromatic type vinyl monomer, the (meth)acrylic acid ester type monomer, and the bireactive monomer can be mixed. Since good mixing can be obtained and control of polymerization becomes easier, for example, the temperature can be within the range of 80 to 120° C., more preferably within the range of 85 to 115° C., and even more preferably within the range of 90 to 110° C.

Preferably, the relative percentage of the aromatic type vinyl monomer and the (meth)acrylic acid ester type monomer is a percentage so that the glass transition temperature (Tg) calculated by the FOX formula represented by Scheme (i) below is within the range of 35 to 80° C., and preferably within the range of 40 to 60° C.

$$1/Tg=\Sigma(Wx/Tgx) \quad \text{Scheme (i):}$$

(In Scheme (i), Wx is mass fraction of monomer x, Tgx is the glass transition temperature of the homopolymer of the monomer x.)

According to the present specification, the bireactive monomer is not used in the calculation of the glass transition temperature.

<Added Amount of Bireactive Monomer>

Among the non-modified polyester resin, the aromatic type vinyl monomer, the (meth)acrylic acid ester type monomer, and the bireactive monomer, regarding the percentage of the bireactive monomer to be used, when the total mass of the resin material to be used, in other words, the total mass of the above four is 100 mass %, preferably, the ratio of the bireactive monomer is 0.1 to 5.0 mass % or less, and more preferably, 0.5 to 3.0 mass % or less.

<Bireactive Monomer>

The bireactive monomer for forming the vinyl type polymerization segment is to be a monomer including a group which is able to react with the polycarboxylic acid monomer or polyalcohol monomer for forming the polyester type polymerization segment and the polymerizable unsaturated group, and specifically, the following can be used, for example, acrylic acid, methacrylic acid, fumaric acid, maleic acid, and maleic acid anhydride. It is preferable to use the acrylic acid or the methacrylic acid as the bireactive monomer in the present invention.

<Vinyl Type Polymerization Segment>

The aromatic type vinyl monomer and the (meth)acrylic acid ester type monomer for forming the vinyl type polymerization segment includes ethylenic unsaturated bond which may perform radical polymerization.

(Aromatic Type Vinyl Monomer and the (Meth)Acrylic Acid Ester Type Monomer)

Examples of an aromatic type vinyl monomer include the following, styrene, o-methylstryrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene, and derivatives thereof.

The above aromatic type vinyl monomer may be used alone or by combining two or more kinds.

Examples of a (meth)acrylic acid ester type monomer include the following: methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethylaminoethyl methacrylate, and diethylaminoethyl methacrylate. The above (meth)acrylic acid ester type monomer may be used alone or by combining two or more kinds.

From the view point of obtaining excellent charging and image quality attribute, it is preferable to mainly use styrene or its derivatives as the aromatic type vinyl monomer and the (meth)acrylic acid ester type monomer for forming the vinyl type polymerization segment. Specifically, preferably, the amount of styrene or its derivatives used in the entire amount of monomer used for forming the styrene-acrylic type polymerization segment (aromatic type vinyl monomer and (meth)acrylic acid ester type monomer) is 50 mass % or more.

(Polymerization Initiator)

Preferably, in the above described polymerization step where the aromatic type vinyl monomer and the (meth) acrylic acid ester type monomer are polymerized, the polymerization is performed in the presence of a radical polymerization initiator. The timing that the radical polymerization initiator is added is not limited. Preferably, the radical polymerization initiator is added after the mixing step to enable easier control of the radical polymerization.

Various well-known polymerization initiators are suitably used as the polymerization initiator. Specifically, examples of a polymerization initiator include: peroxides such as, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, peroxy diisopropyl carbonate, tetraphosphor hydroperoxide, 1-phenyl-2-methylpropyl-1-hydroperoxide, pertriphenyl tert-hydroperoxide acetate, tert-butyl performate, tert-butyl peracetate, tert-butyl perbenzoate, tert-butyl perphenyl acetate, tert-butyl permethoxy acetate, and per N-(3-tolyl) tert-butyl palmitate; and azo compounds such as 2,2'-azobis(2-amidinopropane) hydrochloride, 2,2'-azobis(2-amidinopropane) nitrate, 1,1'-azobis(1-methylbutylonitrile-3-sodium sulfonate), 4,4'-azobis-4-cyanovalerate, and poly(tetraethyleneglycol-2,2'-azobis isobutyrate). The added amount of the polymerization initiator is different depending on the desired molecular weight and the molecular weight distribution.

Specifically, it is preferable to add the polymerization initiator within the range of 0.1 to 5.0 mass % with respect to the polymerizable monomer.

(Chain Transfer Agent)

Typically used chain transfer agents can be used for the purpose of adjusting the molecular weight of the styrene-acrylic type polymerization segment in the above described polymerizing step to polymerize the aromatic type vinyl monomer and the (meth)acrylic acid ester type monomer. The chain transfer agent is not limited, and examples include alkyl mercaptan and mercapto fatty acid ester.

Preferably, the chain transfer agent is mixed with resin forming material in the above described mixing step.

The added amount of the chain transfer agent is different depending on the desired molecular weight and the molecular weight distribution of the styrene-acrylic type polymerization segment. Specifically, it is preferable that the chain transfer agent is added within the range of 0.1 to 5.0 mass % with respect to the total mass of the aromatic type vinyl monomer, the (meth)acrylic acid ester type monomer, and the bireactive monomer.

The polymerization temperature of the above described polymerization step where the aromatic type vinyl monomer and the (meth)acrylic acid ester type monomer are polymerized is not limited. The temperature can be suitably selected within the range that the polymerization of the aromatic type vinyl monomer and the (meth)acrylic acid ester type monomer progresses and the bonding to the polyester resin progresses. For example, as the polymerization temperature, the range within 85 to 125° C. is preferable, the range within 90 to 120° C. is more preferable, and the range within 95 to 115° C. is further preferable.

<Polyester Type Polymerization Segment>

Preferably, the resin used for making the polyester type polymerization segment composing the hybrid amorphous polyester resin of the present invention is a resin produced from raw materials including a polycarboxylic acid monomer (derivative) and a polyalcohol monomer (derivative) by polycondensation reaction in the presence of a suitable catalyst.

The following may be used as the polycarboxylic acid monomer: alkyl ester, acid anhydride, and acid chloride of the polycarboxylic acid monomer. The following may be used as the polyalcohol monomer: an ester compound of a polyalcohol monomer, and hydroxycarboxylic acid.

The polycarboxylic acid monomer includes the following, for example: divalent carboxylic acid such as, oxalic acid, succinic acid, maleic acid, adipic acid, β-methyl adipic acid, azelaic acid, sebacic acid, nonane dicarboxylic acid, decane dicarboxylic acid, undecane dicarboxylic acid, dodecane dicarboxylic acid, fumaric acid, citraconic acid, diglycol acid, cyclohexane-3,5-diene-1,2-dicarboxylic acid, malic acid, citric acid, hexahydro terephtalic acid, malonic acid, pimelic acid, tartaric acid, mucic acid, phthalic acid, isophthalic acid, terephthalic acid, tetrachlorophthalic acid, chlorophthalic acid, nitrophthalic acid, p-caboxyphenylacetic acid, p-phenylene diacetate, m-phenylene diglycol acid, p-phenylene diglycol acid, o-phenylene diglycol acid, diphenylacetic acid, diphenyl-p,p'-dicarboxylic acid, naphthalane-1,4-dicarboxylic acid, naphthalane-1,5-dicarboxylic acid, naphthalane-2,6-dicarboxylic acid, anthracene dicarboxylic acid, dodecenyl succinic acid, etc.; and trivalent or more carboxylic acid such as trimellitic acid, pyromellitic acid, naphthalene tricarboxylic acid, naphthalene tetracarboxylic acid, pyrene tricarboxylic acid, and pyrene tetracarboxylic acid.

The polycarboxylic acid monomer used is preferably unsaturated aliphatic dicarboxylic acid such as fumaric acid, maleic acid, and mesaconic acid. Especially, the unsaturated aliphatic dicarboxylic acid represented by the above Formula (A) is preferably used. According to the present invention, anhydride of dicarboxylic acid such as maleic acid anhydride may be used.

The polyalcohol monomer includes the following, for example: divalent alcohol such as ethylene glycol, propylene glycol, butane diol, diethylene glycol, hexane diol, cyclohexane diol, octane diol, decane diol, dodecane diol, ethylene oxide adduct of bisphenol A, propylene oxide adduct of bisphenol A, etc.; polyol of trivalent or more such as glycerin, pentaerythritol, hexamethylol melamine, hexaethylol melamine, tetramethylol benzoguanamine, and tetraethylol benzoguanamine.

In order to form the polyester type polymerization segment composing the hybrid amorphous polyester resin relating to the present invention, it is preferable to use a polycarboxylic acid and a polyalcohol that does not include a straight alkyl group.

The above-described polyalcohol monomer is characterized in containing: an ethylene oxide adduct of bisphenol A; and a propylene oxide adduct of bisphenol A as constituting units.

By containing: the constituting members of the ethylene oxide adduct of bisphenol A; and the propylene oxide adduct of bisphenol A, it may be controlled the compatibility with the crystalline resin. It may be prevent exposure of the crystalline resin on the surface of the precursor for the toner mother particles.

The ratio between the above polycarboxylic acid monomer and the polyalcohol monomer is an equivalent ratio [OH]/[COOH] between the hydroxyl group [OH] of the polyalcohol monomer and the carboxy group [COOH] of the polycarboxylic acid being preferably 1.5/1 to 1/1.5 and more preferably 1.2/1 to 1/1.2.

Various conventionally well-known catalysts may be used as the catalyst for synthesizing the polyester resin.

The amorphous polyester resin for obtaining the hybrid amorphous polyester resin has a glass transition temperature preferably in the range of 40 to 70° C., and more preferably in the range of 50 to 65° C. When the glass transition temperature of the amorphous polyester resin is 40° C. or more, the aggregation force of the polyester resin in the high temperature region becomes suitable and it is possible to suppress hot offset in fixing. When the glass transition temperature of the amorphous polyester resin is 70° C. or less, sufficient melting may be achieved in fixing so that a suitable minimum fixing temperature may be secured.

The weight average molecular weight (Mw) of the amorphous polyester resin is preferably in the range of 1,500 to 60,000, and more preferably within the range of 3,000 to 40,000.

When the weight average molecular weight is 1,500 or more, suitable aggregation force may be obtained in the entire resin for toner mother particle precursor, and high temperature offset in fixing is suppressed. When the weight average molecular weight is 60,000 or less, sufficient melt viscosity may be obtained, and sufficient minimum fixing temperature may be secured. Therefore, the low-temperature offset is suppressed in fixing.

A branching structure or a bridged structure may be partially formed in the amorphous polyester resin by selecting the valence of carboxylic acid or the valence of alcohol in the polycarboxylic acid monomer or the polyalcohol monomer used.

When making the hybrid amorphous polyester resin, the volatile organic matter from emulsion such as residual monomer after the polymerization step is preferably suppressed to 1,000 ppm or less for practical use, more preferably to 500 ppm or less, and even more preferably to 200 ppm or less.

A colorant and a charge control agent may be added to the toner mother particles of the present invention when needed.

<Colorant>

When the toner mother particles are constituted to include a colorant, carbon black, a magnetic material, a dye, or a pigment may be arbitrarily used as the colorant.

As carbon black, channel black, furnace black, acetylene black, thermal black, and lamp black may be used.

Examples of a magnetic material that may be used include the following: ferromagnetic metal such as iron, nickel, and cobalt; alloy including the above metal; and a compound of the ferromagnetic metal such as ferrite and magnetite.

As a pigment, the following may be used: C.I. pigment red 2, C.I. pigment red 3, C.I. pigment red 5, C.I. pigment red 7, C.I. pigment red 15, C.I. pigment red 16, C.I. pigment red 48:1, C.I. pigment red 48:3, C.I. pigment red 53:1, C.I. pigment red 57:1, C.I. pigment red 81:4, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 208, C.I. pigment red 209, C.I. pigment red 222, C.I. pigment orange 31, C.I. pigment orange 43, C.I. pigment yellow 3, C.I. pigment yellow 9, C.I. pigment yellow 14, C.I. pigment yellow 17, C.I. pigment yellow 35, C.I. pigment yellow 36, C.I. pigment yellow 65, C.I. pigment yellow 74, C.I. pigment yellow 83, C.I. pigment yellow 93, C.I. pigment yellow 94, C.I. pigment yellow 98, C.I. pigment yellow 110, C.I. pigment yellow 111, C.I. pigment yellow 138, C.I. pigment yellow 139, C.I. pigment yellow 153, C.I. pigment yellow 155, C.I. pigment yellow 180, C.I. pigment yellow 181, C.I. pigment yellow 185, C.I. pigment green 7, C.I. pigment blue 15:3, C.I. pigment blue 15:4, C.I. pigment blue 60, phthalocyanine pigment in which the main metal is zinc, titanium, magnesium, etc., and mixtures of the above. As dye, the following can be used, C.I. solvent red 1, C.I. solvent red 3, C.I. solvent red 14, C.I. solvent red 17, C.I. solvent red 18, C.I. solvent red 22, C.I. solvent red 23, C.I. solvent red 49, C.I. solvent red 51, C.I. solvent red 52, C.I. solvent red 58, C.I. solvent red 63, C.I. solvent red 87, C.I. solvent red 111, C.I. solvent red 122, C.I. solvent red 127, C.I. solvent red 128, C.I. solvent red 131, C.I. solvent red 145, C.I. solvent red 146, C.I. solvent red 149, C.I. solvent red 150, C.I. solvent red 151, C.I. solvent red 152, C.I. solvent red 153, C.I. solvent red 154, C.I. solvent red 155, C.I. solvent red 156, C.I. solvent red 157, C.I. solvent red 158, C.I. solvent red 176, C.I. solvent red 179, pyrazolotriazole azo dye, pyrazolotriazole azomethine dye, pyrazolone azo dye, pyrazolone azomethine dye, C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. solvent yellow 162, C.I. solvent blue 25, C.I. solvent blue 36, C.I. solvent blue 60, C.I. solvent blue 70, C.I. solvent blue 93, and C.I. solvent blue 95, and mixtures of the above.

When the toner mother particle is constituted to include a colorant, the content ratio of the colorant in the toner with respect to the total mass of the resin for toner mother particle precursor is preferably in the range of 1 to 30 mass %, and more preferably in the range of 2 to 20 mass %.

<Charge Control Agent>

Various well-known charge control agents may be used in the toner mother particles relating to the present invention.

Various well-known compounds which can be dispersed in an aqueous medium may be used as the charge control agent. Specific examples include: nigrosine type dye, metallic salt of naphthenic acid or higher fatty acid, amine alkoxylate, quaternary ammonium salt compound, azo type metal complex, salicylic acid metallic salt or its metal complex.

The content ratio of the charge control agent with respect to the total mass of the resin for toner mother particle precursor is preferably in the range of 0.1 to 10.0 mass %, and more preferably in the range of 0.5 to 5.0 mass %.

<Average Degree of Circularity of Toner Particles>

The average degree of circularity of the toner particles used in the present invention is preferably in the range of 0.940 to 0.980.

Here, the average degree of circularity of the toner particles is a value measured using the flow type particle image analysis apparatus "FPIA-2100" (manufactured by Sysmex Corporation).

Specifically, the toner particles are moistened in an aqueous surfactant solution, and ultrasonic dispersion is performed for 1 minute. After dispersion, measurement is performed in a suitable concentration within the range of HPF (high power field imaging) detected number 3,000 to 10,000 under a measurement condition in a HPF mode using the "FPIA-2100". A reproducible measurement value may be obtained within the above range. The degree of circularity is calculated by the formula below.

Degree of circularity=(Circumference of circle with the same projected area as particle image)/(Circumference of particle projected image)

The average degree of circularity is an average value calculated by adding the degree of circularity of each particle and dividing the above with the total number of measured particles.

<Particle Diameter of Toner Particle>

The particle diameter of the toner particle used in the present invention is preferably in the range of 3 to 10 μm in a volume-based median diameter ($D_{50}$% diameter).

When the volume-based median diameter ($D_{50}$% diameter) is in the above range, it is possible to accurately reproduce the extremely fine dot image at a level of, for example, 1,200 dpi (dpi; number of dots per inch (2.54 cm)).

The volume-based median diameter ($D_{50}$% diameter) of the toner particle may be measured and calculated by connecting an apparatus such as "Multisizer 3 (manufactured by Beckman Coulter, Inc.)" to a computer system for data processing.

In the measuring process, 0.02 g of the toner particles is blended in 20 ml of the surfactant solution (for the purpose of dispersing toner particles, for example, a surfactant solution in which a neutral detergent including a surfactant component is diluted by 10 times with pure water), ultrasonic dispersion is performed for 1 minute and a toner particle dispersion liquid is made. This toner particle dispersion liquid is poured into a beaker including ISOTON II (manufactured by Beckman Coulter, Inc.) in the sample stand with a pipette until the measurement concentration is within the range of 5 to 10 mass %, and the liquid is measured setting the measurement counter to 25,000. The aperture diameter of the Multisizer 3 used is 100 μm. The frequency count is calculated by dividing the range of the measurement range 1 to 30 μm by 256 and the particle diameter at 50% from the volumetric integrated fraction with a large value is to be the volume-based median diameter ($D_{50}$% diameter).

<Softening Point of Toner>

The softening point of the toner of the present invention is preferably in the range of 90 to 115° C. When the softening point of the toner is in this range, preferable low-temperature fixability may be achieved. The softening point may be measured by the above described method, in other words, it may be measured by using the flow tester "CFT-500D" (manufactured by Shimadzu Corporation).

[General Outline of Production Method of Electrostatic Image Developing Toner]

The production method of the toner relating to the present invention is characterized in having an average degree of circularity of the toner mother particle precursor to be 0.890 or more. Further, the method is characterized in forming the convex portion by bonding the above-described hybrid amorphous polyester resin on the surface of the toner mother particle precursor <Average Degree of Circularity of Toner Mother Particle Precursor>

The average degree of circularity of the toner mother particle precursor used in the present invention is characterized in being 0.890 or more.

Here, the average degree of circularity of the toner mother particle precursor is a value measured using the flow type particle image analysis apparatus "FPIA-2100" (manufactured by Sysmex Corporation).

Specifically, the toner mother particle precursor is moistened in an aqueous surfactant solution, and ultrasonic dispersion is performed for 1 minute. After dispersion, measurement is performed in a suitable concentration within the range of HPF (high power field imaging) detected number 3,000 to 10,000 under a measurement condition in a HPF mode using the "FPIA-2100". A reproducible measurement value may be obtained within the above range. The degree of circularity is calculated by the formula below.

In addition, when the toner mother particles are produced with an emulsion aggregation method, they are produced in a wet condition. Therefore, it is possible to omit the step of dispersion by being moistened in an aqueous surfactant solution, and subjecting to ultrasonic dispersion for 1 minute.

Degree of circularity=(Circumference of circle with the same projected area as particle image)/(Circumference of particle projected image)

The average degree of circularity is an average value calculated by adding the degree of circularity of each particle and dividing the above with the total number of measured particles.

<Manufacturing Method of Toner Mother Particles>

The method for manufacturing the toner mother particles of the present invention includes: suspension polymerization method, emulsion aggregation method, and other well-known methods. Preferably, the emulsion aggregation method is employed. From the view point of manufacturing cost and manufacturing stability, according to the emulsion aggregation method, it is possible to easily achieve smaller particle diameter of toner particles.

Here, the emulsion aggregation method is a method of manufacturing toner particle by the following. Dispersion liquids of the particle of the resin for toner mother particle precursor (specifically, a dispersion liquid of vinyl resin particles and a dispersion liquid of crystalline resin particles) manufactured by emulsifying are mixed with a dispersion liquid of particles of a colorant (hereinafter also referred to as "colorant particle") as necessary to aggregate until the desired toner particle diameter is obtained, and further, the shape is controlled by fusing among the resin particles. Here, the particles of the resin for toner mother particle precursor may arbitrarily include a mold release agent, and a charge control agent.

It is preferable that the toner mother particles of the present invention are manufactured by the emulsion aggregation method.

When the toner mother particles of the present invention are manufactured by the emulsion aggregation method, an example of the process of manufacturing the toner mother particles is specifically described as follows.

Step (1): preparing a dispersion liquid of resin (101) particles composed of resin (101) for toner mother particle precursor Step (2): preparing a dispersion liquid of resin (102) particles composed of convex portion resin (102)

Step (3): aggregating resin (101) particles included in the dispersion liquid of the resin (101) particles for toner mother particle precursor and to form a toner mother particle precursor Step (4): fusing the convex portion resin (102) particles to the toner mother particle precursor in the aqueous medium and to form toner mother particle With these steps, the toner mother particle is formed.

The resin (101) particles for toner mother particles in the above step (1) may include a multilayer structure of 2 or more layers from resin with different composition. The resin particles with such structure may be obtained by the following. For example, in a 2 layer structure, first the dispersion liquid with the resin particle is prepared by the emulsion polymerization process (first polymerization) according to the usual method, then, the polymerization initiator and the polymerizable monomer are added to this dispersion liquid, and the polymerization process (second polymerization) is performed on the above. Moreover, the polymerizable monomer may be further added as necessary and third polymerization may be performed to achieve a 3 layer structure.

After the above step (4), the toner mother particles are filtered from the aqueous medium. Then, a cleaning step to remove the surfactant from the toner mother particles, and a drying step to dry the cleaned toner mother particles is performed. Further, the additive adding step to add the additive to the dried toner mother particle is performed as necessary. With these steps, the toner particles may be manufactured.

According to the present invention, the "aqueous medium" is a medium including 50 to 100 mass % of water and 0 to 50 mass % of water soluble organic solvent. Examples of a water soluble organic solvent include: methanol, ethanol, isopropanol, butanol, acetone, methyl ethyl ketone, and tetrahydrofuran. An alcohol type organic solvent which does not dissolve the obtained resin is preferable.

(Step (1): Preparing Dispersion Liquid of Resin (101) Particles Composed of Resin (101) for Toner Mother Particle Precursor)

In the step (1), it is prepared a dispersion liquid of the wax containing resin (101) particles in which wax is contained in the resin (101).

The dispersion liquid of the wax containing resin (101) particles may be prepared by emulsion polymerization in an aqueous medium.

An average particle diameter of the resin (101) particles in the dispersion liquid of resin (101) particles is preferably in the range of 50 to 500 nm in a volume-based median diameter from the viewpoint of controlling the average long side length and the average distance of the convex portions in the above-described range.

When a surfactant is used in the polymerization step of the resin (101), the above-described surfactants may be used as a surfactant.

The above surfactants may be used alone or in combination of two or more kinds depending on the needs.

The toner mother particles of the present invention may include internal additives such as colorant, wax, charge control agent or magnetic powder when needed. Such internal additives may be introduced in the toner particles by, for example, in the polymerization step of resin (101), dissolving or dispersing in advance in the monomer solution for forming the resin (101).

Alternatively, the above internal additive may be introduced in the toner particles by separately preparing a dispersion liquid of the internal additive particles formed from only the internal additive and aggregating the internal additive particles together with the resin (101) particles and the colorant particles in step (3). However, it is preferable to employ the method in which the internal additive is introduced in advance in the polymerization step of resin (101).

The volume-based median diameter ($D_{50}$% diameter) is measured using the micro track particle diameter distribution measurement apparatus "UPA-150" (manufactured by Nikkiso Co., Ltd.).

(Step (2): Preparing a Dispersion Liquid of Convex Portion Resin (102) Particles)

In step (2), a dispersion liquid of resin particles composed of convex portion resin (102).

The following methods may be used to prepare the dispersion liquid of the resin particles composed of convex portion resin (102). Specifically, for example: a method of grinding the convex portion resin (102) by a mechanical method and dispersing in the aqueous medium using the surfactant; a method of pouring and dispersing in the aqueous medium a solution of the convex portion resin (102) dissolved in the organic solvent to make the aqueous medium dispersion liquid; a method of mixing the convex portion resin (102) in a melted state in the aqueous medium and making the aqueous medium dispersion liquid by a mechanical dispersion method; and a phase transfer emulsion method. Any method may be employed in the present invention.

The average particle diameter of the convex portion resin (102) particles obtained in the step (2) is preferably in the range of, for example, 50 to 500 nm in the volume-based median diameter ($D_{50}$% diameter).

When the surfactant is used in the step (2), the surfactants that may be used are the same as those described as the surfactants which may be used in the above described resin (101) particle dispersion liquid preparing step.

(Colorant Particle Dispersion Liquid Preparing Step)

When the colorant is included in the toner mother particles, it is preferable that the step of preparing the colorant particle dispersion liquid is performed.

Specifically, the colorant particle dispersion liquid may be prepared by dispersing colorant in the aqueous medium. Preferably, the dispersion processing of the colorant is performed in a state where surfactant concentration in the aqueous medium is critical micelle concentration (CMC) or more so that the colorant is dispersed evenly. Various well-known dispersers may be used as the disperser used in the dispersion processing of the colorant.

The surfactants that may be used are the same as those described as the surfactants which may be used in the above described resin (101) particle dispersion liquid preparing step.

The dispersion diameter of the colorant particle in the colorant particle dispersion liquid prepared in the colorant particle dispersion liquid preparing step is preferably within the range of, for example, 10 to 300 nm in the volume-based median diameter ($D_{50}$% diameter).

The volume-based median diameter ($D_{50}$% diameter) of the colorant particle in the colorant particle dispersion liquid is measured using the electrophoretic light scattering photometer "ELS-800" (manufactured by Otsuka Electronics Co., Ltd.).

(Step (3): Aggregating Resin (101) Particles Included in the Dispersion Liquid of the Resin (101) Particle Precursor for Toner Mother Particles and to Form a Toner Mother Particle Precursor)

In the step (3), the resin (101) particles included in the dispersion liquid of the resin (101) particles are aggregated to form the toner mother particle precursor.

In the step (3), other particles that constitute the toner such as charge control agent and colorant particles may be aggregated according to necessity.

In addition, in the step (1), the resin (101) particles contain the mold release agent. However, in the step (1), the mold release agent may not be contained in the resin (101) particles. It may be separately prepared a dispersion liquid that contains only the mold release agent, and the dispersion liquid that contains only the mold release agent may be added in the resin (101) particle dispersion liquid in the step (3).

The specific method of aggregating the resin (101) particles included in the dispersion liquid of the resin (101) particles to form the toner mother particle precursor is not limited. An example of such method is adding the aggregation agent in the aqueous medium so that the concentration becomes the critical aggregation concentration or more, and then heating to a temperature equal to or more than the glass transition temperature of the resin (101) particles and equal to or less than the melting peak temperature of the above mixture to progress the salting out of the particles such as the resin (101) particle and the colorant particle simultaneously with the fusing.

Preferably, heating is done promptly after adding the aggregation agent making the time left as is as short as possible at a temperature equal to or more than the glass transition temperature of the resin (101) particles and equal to or less than the melting peak temperature of the above mixture. Although the reason is not clear, there is a possibility that problems may occur such as, the aggregation state of the particle may change depending on the time of being left as is after salting out and the particle diameter distribution may become unstable, or the surface nature of the fused particle may change. Preferably, the time until the heating starts is usually within 30 minutes or less, and more preferably within 10 minutes or less. Preferably, the heating speed is 1° C. per minute or more. The upper limit of the heating speed is not specifically defined. Preferably, from the viewpoint of suppressing coarse particles due to progress of rapid fusing, the upper limit is 10° C. per minute or less. Further, after the reacted result reaches the temperature equal to or more than the glass transition temperature, it is important to maintain the temperature of the reacted result for a certain period of time to continue fusing. With this, the growth of the toner mother particle precursor and the fusing can effectively progress, and with this, the durability of the finally obtained toner particle can be enhanced.

The toner mother particle precursor is produced by aggregating and fusing of the crystalline resin particles and the vinyl resin particles in the presence of metal ions.

Here, the crystalline resin will efficiently exhibit low-temperature fixability by finely dispersed to the inside of the toner. Further, as described above, the crystalline resin is required to be not present on the surface of the toner mother particle. Consequently, it is preferable that the crystalline resin is added before the growing of the toner mother particle precursor, such as at the time of just before or after adding an aggregation agent, or at the time when the reaction system attains to a required temperature.

(Aggregation Agent)

The aggregation agent used in the step (3) is not limited, and the aggregation agent selected from metallic salt is suitably used. Examples of metallic salt include, for example: univalent metallic salt of alkali metal such as sodium, potassium, and lithium; divalent metallic salt such as calcium, magnesium, manganese, and copper; and trivalent metallic salt such as iron and aluminum. Examples of specific metallic salt include: sodium chloride, potassium chloride, lithium chloride, calcium chloride, magnesium chloride, zinc chloride, copper sulfate, magnesium sulfate, and manganese sulfate. Among the above, it is especially preferable to use divalent metallic salt because it is possible to progress aggregation with a smaller amount. These may be used alone or in combination of two or more kinds.

The particle diameter of the toner mother particle precursor obtained in the step (3) is preferably in the range of, for example, 3 to 10 μm in the volume-based median diameter ($D_{50}$% diameter), and more preferably in the range of 4 to 7 μm.

The volume-based median diameter ($D_{50}$% diameter) of the toner mother particle precursor is measured by the "Coulter Multisizer 3" (manufactured by Beckman Coulter, Inc.).

(Step (4): Forming Toner Mother Particles)

In step (4), the resin (1022) particles are fused to the toner mother particle precursor in the aqueous medium to form the toner mother particles.

Specifically, in the step (3), when the toner mother particle grows to a desired particle diameter, and the average degree of circularity measured using the apparatus for measuring the average degree of circularity of the toner "FPIA-2100" (manufactured by Sysmex Corporation) is in the range of 0.890 or more (HPF detecting number 4000), the dispersion liquid of the resin (102) particles is poured in the aqueous medium (reacting liquid) of the step (3), and the resin (102) particles are attached to the toner mother particle precursor. Then, the pH of the aqueous medium (reacting liquid) is adjusted by the pH adjuster and the particles are fused.

A specific method is as follows, first, the aggregation agent is added to the reacting liquid to be the critical aggregation concentration or more, and then the result is heated to a temperature equal to or more than the glass transition temperature of the resin (102) particle and equal to or less than the melting peak temperature of the mixture of the above.

Next, when the supernatant of the reacting liquid (aqueous medium) becomes transparent, the aggregation terminator is added and the growth of the particle is terminated. Then, the temperature is raised, and the pH adjuster is added to adjust the pH of the aqueous medium in fusing. The above is heated and mixed in a state within the range of 80 to 90° C.

With this, the convex portion can be formed on the surface of the toner mother particle precursor and the toner mother particle can be formed. When the average degree of circularity measured using the apparatus for measuring the average degree of circularity of the toner "FPIA-2100" (manufactured by Sysmex Corporation) is within the range of 0.950 to 0.970 (HPF detecting number 4000), the above is cooled within the range of 20 to 30° C. to obtain the dispersion liquid of the toner mother particle including the convex portion on the surface.

In addition, in the step for forming the toner mother particles, the fusing time to fuse the resin (102) to the toner mother particle precursor is preferably in the range of 10 to 180 minutes. More preferably, it is in the range of 30 to 120 minutes from the viewpoint of controlling the average long side length and the average distance of the convex portions in the above-described range.

(Cleaning Step, Drying Step)

Various well-known methods may be employed and performed in the cleaning step and the drying step. In other words, after forming to a predetermined average degree of circularity in the forming step, for example, by using a well-known method such as a centrifuge, solid-liquid separation and cleaning is performed, organic solvent is removed by drying under reduced pressure, and further, the moisture and the fine amount of organic solvent are removed with a well-known drying apparatus such as a flash jet dryer and fluid bed dryer. The drying temperature is not limited as long as the toner is not fused.

(External Additive Adding Step)

The external additive adding step adds and mixes the external additive to the dried toner mother particle as necessary to prepare the toner particles.

The toner mother particles made up to the drying process may be used as the toner particles as they are. However, from the viewpoint of enhancing charge performance, fluidity as toner and cleaning performance, preferably, particles such as well-known inorganic and organic particles, and a lubricant are added as an external additive.

Various kinds may be used in combination as external additives.

Examples of inorganic particles include, for example: inorganic oxide particles such as silica particle, alumina particle, and titanic oxide particle, inorganic stearin acid compound particles such as aluminum stearate particle and zinc stearate particle, inorganic titanic acid compound particles such as strontium titanate and zinc titanate.

Preferably, the surface of such inorganic particles are processed by silane coupling agent, titanium coupling agent, higher fatty acid or silicone oil from the viewpoint of thermal resistance storage performance and environment stability.

The added amount of these additives is in the range of 0.05 to 5 mass parts with respect to 100 mass parts of the toner mother particles, and preferably in the range of 0.1 to 3 mass parts.

Examples of the method of adding an external additive include a dry type method in which an external additive is added in a powder state to the dried toner mother particle. Examples of mixing apparatuses include: a mechanical mixing apparatus such as Henschel mixer or coffee mill.

[Developer]

The toner of the present invention may be used as the magnetic or non-magnetic one component developer, or mixed with a carrier and used as the two component developer.

Examples of the carrier that may be used include magnetic particles from conventionally well-known material such as metal such as iron, ferrite, and magnetite, and alloys of the above metal with metal such as aluminum or lead. Among them, ferrite particles are preferably used. Other examples of the carrier that may be used include coated carrier in which the surface of the magnetic particles is covered with a covering agent such as resin or resin dispersed type carrier in which magnetic fine powder is dispersed in the binder resin.

The carrier has a volume-based average particle diameter preferably in the range of 15 to 100 μm and more preferably within the range of 25 to 80 μm.

Although embodiments of the present invention have been described and illustrated in detail, it is clearly understood that the same is by way of illustration and example only and not limitation, the scope of the present invention should be interpreted by terms of the appended claims.

Examples

The present invention is specifically described with reference to the examples in the following, however, the present invention is not limited to these examples. In the examples described below, "parts" or "%" is used in the description, and it represents "mass parts" or "mass %" respectively unless specific notice is given.

[Preparation of Vinyl Resin Particle Dispersion Liquid (1) (Vinyl Resin Particle Dispersion Liquid for Toner Mother Particle Precursor)]

(1) First Step Polymerization

Into a 5 L reaction vessel equipped with a stirrer, a temperature sensor, a cooling tube and a nitrogen introducing device, 8 mass parts of sodium dodecyl sulfate and 3,000 mass parts of ion-exchanged water were charged. While stirring at a stirring speed of 230 rpm under a nitrogen flow, the inner temperature of the reaction vessel was raised to 80° C.

After the temperature was raised, an aqueous solution of 10 mass parts of potassium persulfate dissolved in 200 mass parts of ion-exchanged water was added thereto, and the liquid temperature was raised to 80° C. A monomer mixture composed of the following was added thereto dropwise over 1 hour.

Styrene: 480.0 mass parts;
n-Butyl acrylate: 250.0 mass parts;
Methacrylic acid: 68.0 mass parts; and
n-Octyl mercaptan: 16.4 mass parts.

Then, the reaction system was heated and stirred at 80° C. for 2 hours to carry out the polymerization. A vinyl resin particle dispersion liquid (A) was thus prepared.

(2) Second Step Polymerization

Into a 5 L reaction vessel equipped with a stirrer, a temperature sensor, a cooling tube and a nitrogen introducing device, a solution of 7 mass parts of sodium dodecyl sulfate dissolved in 3,000 mass parts of ion-exchanged water was charged. After heating to 98° C., a mixture of: 300 mass parts of the vinyl resin particle dispersion liquid (A) (in solid fraction) prepared in the first step polymerization, a monomer mixture composed of the following and a releasing agent dissolved at 90° C. were added.

| | |
|---|---|
| Styrene: | 243.0 mass parts; |
| n-Butyl acrylate: | 45.5 mass parts; |
| 2-Ethylhexyl acrylate | 45.5 mass parts; |

-continued

| | |
|---|---|
| Methacrylic acid: | 33.1 mass parts; |
| n-Octyl mercaptan: | 5.5 mass parts; and |
| Behenyl behenate (mold release agent, mp. 73° C.): | 130.0 mass parts. |

The reaction system was mixed and dispersed for 1 hour by using a mechanical disperser with a circulation route "CLEARMIX" (M Technique Co., Ltd.) so that a dispersion liquid containing emulsion particles (oil particles) was prepared.

Then, an initiator solution of 6 mass parts of potassium persulfate dissolved in 200 mass parts of ion-exchanged water was added to the dispersion liquid, and the system was heated and stirred at 78° C. for 1 hour to carry out polymerization. An amorphous vinyl resin particle dispersion liquid (B) was thus prepared.

(3) Third Step Polymerization

Then, 400 mass parts of ion-exchanged water were added to the amorphous vinyl resin particle dispersion liquid (B) prepared in the second step polymerization. After sufficiently mixing, a solution of 6.0 mass parts of potassium persulfate dissolved in 400 mass parts of ion-exchanged water was added to the dispersion liquid. A monomer mixture composed of the following was added dropwise thereto at a temperature of 81° C. over 1 hour.

Styrene: 354.8 mass parts;
n-Butyl acrylate: 143.2 mass parts;
Methacrylic acid: 52.0 mass parts; and
n-Octyl mercaptan: 8.0 mass parts.

After the addition, the system was heated and stirred for 2 hours to carry out the polymerization, and the system was then cooled to 28° C. A dispersion liquid of vinyl resin (1) (a vinyl resin particle dispersion liquid (1)) was thus prepared.

[Preparation of Vinyl Resin Particle Dispersion Liquid (2) (Vinyl Resin Particle Dispersion Liquid for Convex Portion)]

A vinyl resin particle dispersion liquid (2) was prepared in the same manner as preparation of vinyl resin particle dispersion liquid (1) except that the monomer mixture used in the first step polymerization was changed as described below. The polymerization and the treatment after reaction were done in the same way.

Styrene: 624 mass parts;
n-Butyl acrylate: 120 mass parts;
Methacrylic acid: 56 mass parts; and
n-Octyl mercaptan: 16.4 mass parts.

[Preparation of Crystalline Resin Particle Dispersion Liquid]

(Production of Crystalline Polyester Resin)

The following monomers were introduced in a four-necked flask equipped with a nitrogen introducing tube, a dehydration tube, a stirrer, and a thermocouple. Then, the mixture was heated to 170° C. to dissolve the content.

Dodecanedioic acid: 440 mass parts; and
1,6-Hexanediol: 173 mass parts.

Then, 0.8 mass parts of $Ti(OBu)_4$ were added as an esterification catalyst, and the mixture was heated to 235° C. The reaction was made under a normal pressure (101.3 kPa) for 5 hours, then further the reaction was made under a reduced pressure (8 kPa).

Subsequently, the reaction mixture was cooled to 200° C., and the reaction was made under a reduced pressure (20 kPa) for 1 hour. Thus, it was obtained a crystalline polyester resin 1.

The obtained crystalline polyester resin 1 had a weight average molecular weight (Mw) of 20,500, an acid value of 22.1 mgKOH/g, and a melting point (mp) of 75.2° C.

(Preparation of Crystalline Resin Particle Dispersion Liquid)

100 mass parts of the obtained crystalline polyester resin were dissolved in 400 mass parts of ethyl acetate (made by Kanto Kagaku Co. Ltd.). Subsequently, 638 mass parts of 0.26 mass % of sodium polyoxyethylene lauryl ether sulfate aqueous solution were added. While stirring this mixture, it was subjected to an ultrasonic dispersion for 30 minutes with an ultrasonic homogenizer "US-150T" (made by Nissei Co. Ltd.) under the condition of V-LEVEL being 300 μA. Subsequently, the mixture was stirred at 40° C. for 3 hours under a reduced pressure by using a diaphragm vacuum pump "V-700" (made by BUCHI Co. Ltd.). During this step, ethyl acetate was completely removed. Thus, it was obtained a crystalline resin particle dispersion liquid. The crystalline resin particles in the dispersion liquid have a volume-based median diameter ($d_{50}$) of 160 nm.

[Preparation of Dispersion Liquid of Hybrid Amorphous Polyester Resin Particles]

(Production of Hybrid Amorphous Polyester Resin (A1))

A mixture of vinyl resin monomers described below, a bireactive monomer having substituents that react with an amorphous polyester resin and a vinyl resin, and a polymerization initiator was loaded in a dropping funnel.

Styrene: 80.0 mass parts;

n-Butyl acrylate: 20.0 mass parts;

Acrylic acid: 10.0 mass parts; and

Di-t-butylperoxide (polymerization initiator);

16.0 mass parts.

The following monomers for amorphous polyester resin were introduced in a four-necked flask equipped with a nitrogen introducing tube, a dehydration tube, a stirrer, and a thermocouple. Then, the mixture was heated to 170° C. to dissolve the content.

Bisphenol A-ethylene oxide 2 mole adduct:

59.1 mass parts;

Bisphenol A-propylene oxide 2 mole adduct:

281.7 mass parts;

Terephthalic acid: 63.9 mass parts; and

Succinic acid: 48.4 mass parts.

Subsequently, the mixed solution in the dropping funnel was added dropwise to the four-necked flask over 90 minutes. Then, after the reaction was continued for another 60 minutes, the unreacted monomers were removed under a reduced pressure (8 kPa) from the four-necked flask. Then, 0.4 mass parts of $Ti(OBu)_4$ were added as an esterification catalyst to the four-necked flask, and the mixture was heated to 235° C. The reaction was made under a normal pressure (101.3 kPa) for 5 hours, then further the reaction was made under a reduced pressure (8 kPa) for one hour.

Subsequently, the mixture was cooled to 200° C., and the reaction was done under a reduced pressure (20 kPa). Then, the solvent was removed. Thus, a hybrid amorphous polyester resin modified with a vinyl resin (A1) was obtained. The obtained hybrid amorphous polyester resin (A1) had a weight average molecular weight (Mw) of 24,000, an acid value of 16.2 mgKOH/g, and a glass transition point (Tg) of 60° C. A hybrid ratio (Mass parts of vinyl type polymerization segment/(Mass parts of vinyl type polymerization segment+Mass parts of polyester type polymerization segment)) of the hybrid amorphous polyester resin (A1) was indicated in Table 1.

(Preparation of Hybrid Amorphous Polyester Resin Particle Dispersion Liquid (1))

100 mass parts of the obtained hybrid amorphous polyester resin (A1) were dissolved in 400 mass parts of ethyl acetate (made by Kanto Kagaku Co. Ltd.). Subsequently, 638 mass parts of 0.26 mass % of sodium polyoxyethylene lauryl ether sulfate aqueous solution were added. While stirring this mixture, it was subjected to an ultrasonic dispersion for 30 minutes with an ultrasonic homogenizer "US-150T" (made by Nissei Co. Ltd.) under the condition of V-LEVEL being 400 μA. Subsequently, the mixture was stirred at 40° C. for 3 hours under a reduced pressure by using a diaphragm vacuum pump "V-700" (made by BUCHI Co. Ltd.). During this step, ethyl acetate was completely removed. Thus it was obtained a hybrid amorphous polyester resin particle dispersion liquid (1) having a solid fraction of 13.5 mass %. The amorphous resin particles in the dispersion liquid have a volume-based median diameter ($d_{50}$) of 98 nm.

(Preparation of Hybrid Amorphous Polyester Resin Particle Dispersion Liquid (2))

100 mass parts of the hybrid amorphous polyester resin (A1) were dissolved in 400 mass parts of ethyl acetate (made by Kanto Kagaku Co. Ltd.). Subsequently, 638 mass parts of 0.26 mass % of sodium polyoxyethylene lauryl ether sulfate aqueous solution were added. While stirring this mixture, it was subjected to an ultrasonic dispersion for 30 minutes with an ultrasonic homogenizer "US-150T" (made by Nissei Co. Ltd.) under the condition of V-LEVEL being 500 μA. Subsequently, the mixture was stirred at 40° C. for 3 hours under a reduced pressure by using a diaphragm vacuum pump "V-700" (made by BUCHI Co. Ltd.). During this step, ethyl acetate was completely removed. Thus it was obtained a hybrid amorphous polyester resin particle dispersion liquid (2) having a solid fraction of 13.5 mass %. The amorphous resin particles in the dispersion liquid have a volume-based median diameter ($d_{50}$) of 64 nm.

(Preparation of Hybrid Amorphous Polyester Resin Particle Dispersion Liquid (3))

100 mass parts of the hybrid amorphous polyester resin (A1) were dissolved in 400 mass parts of ethyl acetate (made by Kanto Kagaku Co. Ltd.). Subsequently, 638 mass parts of 0.26 mass % of sodium polyoxyethylene lauryl ether sulfate aqueous solution were added. While stirring this mixture, it was subjected to an ultrasonic dispersion for 30 minutes with an ultrasonic homogenizer "US-150T" (made by Nissei Co. Ltd.) under the condition of V-LEVEL being 250 μA. Subsequently, the mixture was stirred at 40° C. for 3 hours under a reduced pressure by using a diaphragm vacuum pump "V-700" (made by BUCHI Co. Ltd.). During this step, ethyl acetate was completely removed. Thus it was obtained a hybrid amorphous polyester resin particle dispersion liquid (3) having a solid fraction of 13.5 mass %. The amorphous resin particles in the dispersion liquid have a volume-based median diameter ($d_{50}$) of 205 nm.

(Production of Hybrid Amorphous Polyester Resin (A2))

A mixture of vinyl resin monomers described below, a bireactive monomer having substituents that react with an amorphous polyester resin and a vinyl resin, and a polymerization initiator was loaded in a dropping funnel.

Styrene: 30.0 mass parts;

n-Butyl acrylate: 7.8 mass parts;

Acrylic acid: 3.8 mass parts; and

Di-t-butylperoxide (polymerization initiator):

6.0 mass parts.

The following monomers for amorphous polyester resin were introduced in a four-necked flask equipped with a nitrogen introducing tube, a dehydration tube, a stirrer, and a thermocouple. Then, the mixture was heated to 170° C. to dissolve the content.

Bisphenol A-ethylene oxide 2 mole adduct:
65.0 mass parts;
Bisphenol A-propylene oxide 2 mole adduct:
310.0 mass parts;
Terephthalic acid: 70.0 mass parts; and
Succinic acid: 52.8 mass parts.

Subsequently, the mixed solution in the dropping funnel was added dropwise to the four-necked flask over 90 minutes. Then, after the reaction was continued for another 60 minutes, the unreacted monomers were removed under a reduced pressure (8 kPa) from the four-necked flask. Then, 0.4 mass parts of $Ti(OBu)_4$ were added as an esterification catalyst to the four-necked flask, and the mixture was heated to 235° C. The reaction was made under a normal pressure (101.3 kPa) for 5 hours, then further the reaction was made under a reduced pressure (8 kPa) for one hour.

Subsequently, the mixture was cooled to 200° C., and the reaction was done under a reduced pressure (20 kPa). Then, the solvent was removed. Thus, a hybrid amorphous polyester resin modified with a vinyl resin (A2) was obtained. The obtained hybrid amorphous polyester resin (A2) had a weight average molecular weight (Mw) of 25,000, an acid value of 16.3 mgKOH/g, and a glass transition point (Tg) of 60° C. A hybrid ratio of the hybrid amorphous polyester resin (A2) was indicated in Table 1.

(Preparation of Hybrid Amorphous Polyester Resin Particle Dispersion Liquid (4))

100 mass parts of the hybrid amorphous polyester resin (A2) were dissolved in 400 mass parts of ethyl acetate (made by Kanto Kagaku Co. Ltd.). Subsequently, 638 mass parts of 0.26 mass % of sodium polyoxyethylene lauryl ether sulfate aqueous solution were added. While stirring this mixture, it was subjected to an ultrasonic dispersion for 30 minutes with an ultrasonic homogenizer "US-150T" (made by Nissei Co. Ltd.) under the condition of V-LEVEL being 400 μA. Subsequently, the mixture was stirred at 40° C. for 3 hours under a reduced pressure by using a diaphragm vacuum pump "V-700" (made by BUCHI Co. Ltd.). During this step, ethyl acetate was completely removed. Thus it was obtained a hybrid amorphous polyester resin particle dispersion liquid (4) having a solid fraction of 13.5 mass %. The amorphous resin particles in the dispersion liquid have a volume-based median diameter ($d_{50}$) of 108 nm.

(Production of Hybrid Amorphous Polyester Resin (A3))

A mixture of vinyl resin monomers described below, a bireactive monomer having substituents that react with an amorphous polyester resin and a vinyl resin, and a polymerization initiator was loaded in a dropping funnel.

Styrene: 80.0 mass parts;
n-Butyl acrylate: 20.0 mass parts;
Acrylic acid: 10.0 mass parts; and
Di-t-butylperoxide (polymerization initiator):
6.0 mass parts.

The following monomers for amorphous polyester resin were introduced in a four-necked flask equipped with a nitrogen introducing tube, a dehydration tube, a stirrer, and a thermocouple. Then, the mixture was heated to 170° C. to dissolve the content.

Bisphenol A-propylene oxide 2 mole adduct:
340.0 mass parts;
Terephthalic acid: 66.9 mass parts; and
Maleic anhydride: 27.5 mass parts.

Subsequently, the mixed solution in the dropping funnel was added dropwise to the four-necked flask over 90 minutes. Then, after the reaction was continued for another 60 minutes, the unreacted monomers were removed under a reduced pressure (8 kPa) from the four-necked flask. Then, 0.4 mass parts of $Ti(OBu)_4$ were added as an esterification catalyst to the four-necked flask, and the mixture was heated to 235° C. The reaction was made under a normal pressure (101.3 kPa) for 5 hours, then further the reaction was made under a reduced pressure (8 kPa) for one hour.

Subsequently, the mixture was cooled to 200° C., and the reaction was done under a reduced pressure (20 kPa). Then, the solvent was removed. Thus, a hybrid amorphous polyester resin modified with a vinyl resin (A3) was obtained. The obtained hybrid amorphous polyester resin (A3) had a weight average molecular weight (Mw) of 17,000, an acid value of 15.1 mgKOH/g, and a glass transition point (Tg) of 62° C. A hybrid ratio of the hybrid amorphous polyester resin (A3) was indicated in Table 1.

(Preparation of Hybrid Amorphous Polyester Resin Particle Dispersion Liquid (5))

100 mass parts of the hybrid amorphous polyester resin (A3) were dissolved in 400 mass parts of ethyl acetate (made by Kanto Kagaku Co. Ltd.). Subsequently, 638 mass parts of 0.26 mass % of sodium polyoxyethylene lauryl ether sulfate aqueous solution were added. While stirring this mixture, it was subjected to an ultrasonic dispersion for 30 minutes with an ultrasonic homogenizer "US-150T" (made by Nissei Co. Ltd.) under the condition of V-LEVEL being 400 μA. Subsequently, the mixture was stirred at 40° C. for 3 hours under a reduced pressure by using a diaphragm vacuum pump "V-700" (made by BUCHI Co. Ltd.). During this step, ethyl acetate was completely removed. Thus it was obtained a hybrid amorphous polyester resin particle dispersion liquid (5) having a solid fraction of 13.5 mass %. The amorphous resin particles in the dispersion liquid have a volume-based median diameter ($d_{50}$) of 120 nm.

(Production of Amorphous Polyester Resin (B))

The following monomers for amorphous polyester resin were introduced in a four-necked flask equipped with a nitrogen introducing tube, a dehydration tube, a stirrer, and a thermocouple. Then, the mixture was heated to 170° C. to dissolve the content.

Bisphenol A-ethylene oxide 2 mole adduct:
59.1 mass parts;
Bisphenol A-propylene oxide 2 mole adduct:
281.7 mass parts;
Terephthalic acid: 63.9 mass parts; and
Succinic acid: 48.4 mass parts.

Then, while stirring, 0.4 mass parts of $Ti(OBu)_4$ were added as an esterification catalyst to the four-necked flask. The reaction was made under a nitrogen gas flow at 235° C. for 5 hours.

Subsequently, the mixture was cooled to 200° C., and the reaction was done under a reduced pressure (20 kPa) for another 5 hours. Then, the solvent was removed. Thus, an amorphous polyester resin (B) was obtained. The obtained amorphous polyester resin (B) had a weight average molecular weight (Mw) of 27,000, an acid value of 18.0 mgKOH/g, and a glass transition point (Tg) of 60° C.

(Preparation of Amorphous Polyester Resin Particle Dispersion Liquid (B))

100 mass parts of the amorphous polyester resin (B) were dissolved in 400 mass parts of ethyl acetate (made by Kanto Kagaku Co. Ltd.). Subsequently, 638 mass parts of 0.26 mass % of sodium polyoxyethylene lauryl ether sulfate aqueous solution were added. While stirring this mixture, it was subjected to an ultrasonic dispersion for 30 minutes with an ultrasonic homogenizer "US-150T" (made by Nissei Co. Ltd.) under the condition of V-LEVEL being 400 μA. Subsequently, the mixture was stirred at 40° C. for 3 hours under a reduced pressure by using a diaphragm vacuum pump "V-700" (made by BUCHI Co. Ltd.). During this step, ethyl acetate was completely removed. Thus it was obtained an amorphous polyester resin particle dispersion liquid (B) having a solid fraction of 13.5 mass %. The amorphous resin particles (B) in the dispersion liquid have a volume-based median diameter ($d_{50}$) of 99 nm.

[Preparation of Colorant Particle Dispersion Liquid]

Carbon black ("REGAL 330", made by Cabot Corporation):

100 mass parts;

Anionic surfactant ("NEOGEN SC", made by DKS Co. Ltd.):

15 mass parts; and

Ion-exchanged water: 400 mass parts.

The above-described components were mixed. The mixture was preliminary dispersed with a homogenizer (Ultralax, made by IKA Co.). Then, it was further subjected to a dispersion treatment for 30 minutes at a pressure of 245 MPa with a high-pressure impact dispersion device ULTIMIZER (made by Sugino Machine Ltd.). Thus, it was obtained an aqueous dispersion liquid of black colorant particles. Ion-exchanged water was further added to the obtained dispersion liquid to adjust a solid fraction of 15 mass %, and an aqueous dispersion liquid of black colorant particles (1) was prepared.

A volume-based median diameter ($d_{50}$) of the colorant particles in the aqueous dispersion liquid of black colorant particles (1) was 110 nm from the measurement with "Microtrac UPA-150" (made by Microtracbel Corp.).

[Preparation of Mold Release Agent Particle Dispersion Liquid]

Behenyl behenate (mold release agent, mp. 73° C.):

100 mass parts;

Anionic surfactant ("NEOGEN SC", made by DKS Co. Ltd.):

10 mass parts; and

Ion-exchanged water: 400 mass parts.

The above-described components were mixed and the mixture was heated to 80° C. The mixture was fully dispersed with Ultralax T50 (made by IKA Co.). Then, the mixture was further subjected to a dispersion treatment with a pressure jetting type Gaulin homogenizer. Ion-exchanged water was further added to the obtained dispersion liquid to adjust a solid fraction of 15 mass %, and a dispersion liquid of mold release agent particles (W1) (1) was prepared.

A volume-based median diameter ($d_{50}$) of mold release agent particles in the dispersion liquid was measured with a laser diffraction/scattering type particle diameter distribution analyzer LA-750 (made by Horiba Co. Ltd.). The volume-based median diameter ($d_{50}$) was 220 nm.

[Production of Toner 1]

Into a reaction vessel equipped with a stirrer, a temperature sensor and a cooling tube, there were added: 441 mass parts (in solid fraction) of the vinyl resin particle dispersion liquid (1); 45 mass parts (in solid fraction) of the crystalline resin particle dispersion liquid; 1 mass % (in resin ratio, and in solid fraction) of sodium dodecyl diphenyl ether disulfonate; and 200 mass parts of ion-exchanged water were charged. Thereafter, the pH of the dispersion liquid in the reaction vessel was adjusted to pH 11 at room temperature (25° C.) by adding a 5 mol/L sodium hydroxide aqueous solution.

Thereafter, 40 mass parts (in solid fraction) of the colorant particle dispersion liquid was added thereto. Then, while stirring, an aqueous solution of 40 mass parts of magnesium chloride dissolved in 40 mass parts of ion-exchanged water was added at 30° C. over a period of 10 minutes. After leaving still for 5 minutes, the temperature of the system was raised to 85° C. over 90 minutes. After raised to 85° C., the stirring speed was adjusted so that the increasing rate of the particle diameter became to 0.02 μm/min. The particle diameter of the aggregated particles was increased to have a volume based median particle diameter $d_{50}$ of 6.0 μm measured with a "Coulter Multisizer 3" (made by Beckman Coulter, Inc.). When the volume median particle diameter $d_{50}$ reached 6.0 μm, the stirring speed was adjusted to stop the increase of the particle diameter. While stopping the increase of the particle diameter, the particles was allowed to proceed fusing to have an average circularity of the toner mother particle precursor reached 0.945.

Then, 54 mass parts (in solid fraction) of the dispersion liquid of hybrid amorphous polyester resin particles (1) were added over 90 minutes. At the point of obtaining a clear supernatant fluid of the reaction liquid, it was added an aqueous solution of 15 mass parts of sodium chloride dissolved in 60 mass parts of ion-exchanged water for preventing re-increase of the particle diameter. The particles was allowed to proceed fusing to have an average circularity of the toner mother particle reached 0.961. Then, the system was cooled to 30° C. with a cooling rate of 2.5° C./min.

Then, the above-described particles were separated from the cooled reaction solution. The obtained toner cake was dehydrated, and it was washed by repeating re-dispersion in ion-exchanged water and solid-liquid separation for 3 times. Thereafter, the toner cake was dried at 35° C. for 24 hours to yield toner mother particles.

To 100 mass parts of the obtained toner mother particles were added 0.6 mass parts of hydrophobic silica (number average primary particle diameter=12 nm, hydrophobicity=68), 1.0 mass parts of hydrophobic titanium oxide (number average primary particle diameter=20 nm, hydrophobicity=63), and 1.0 mass parts of sol-gel silica (number average primary particle diameter=110 nm). The mixture was blended at 32° C. for 20 minutes by using a "Henschel mixer" (Nippon Coke & Engineering Co., Ltd.) in the condition of a rotary blade circumferential speed of 40 mm/sec. After mixing, coarse particles were removed by using a filter having an opening size of 45 μm. Thus, a toner 1 was obtained.

[Production of Toner 2]

A toner 2 was produced in the same manner as production of the toner 1 except that the amount of the crystalline polyester resin particle dispersion liquid was changed to be 25 mass parts.

[Production of Toner 3]

A toner 3 was produced in the same manner as production of the toner 1 except that the amount of the crystalline polyester resin particle dispersion liquid was changed to be 75 mass parts.

[Production of Toner 4]

A toner 4 was produced in the same manner as production of the toner 1 except that the amount of the crystalline polyester resin particle dispersion liquid was changed to be 15 mass parts.

[Production of Toner 5]

A toner 5 was produced in the same manner as production of the toner 1 except that the amount of the crystalline polyester resin particle dispersion liquid was changed to be 120 mass parts.

[Production of Toner 6]

A toner 6 was produced in the same manner as production of the toner 1 except that the hybrid amorphous polyester resin particle dispersion liquid (1) was changed to the hybrid amorphous polyester resin particle dispersion liquid (2).

[Production of Toner 7]

A toner 7 was produced in the same manner as production of the toner 1 except that the hybrid amorphous polyester resin particle dispersion liquid (1) was changed to the hybrid amorphous polyester resin particle dispersion liquid (3).

[Production of Toner 8]

A toner 8 was produced in the same manner as production of the toner 6 except that an average degree of circularity of the toner mother particle precursor before adding the hybrid amorphous polyester resin particle dispersion liquid (2) was made to be 0.960.

[Production of Toner 9]

A toner 9 was produced in the same manner as production of the toner 7 except that the amount of the hybrid amorphous polyester resin particle dispersion liquid (3) was made to be 108 mass parts, and that an average degree of circularity of the toner mother particle precursor before adding the hybrid amorphous polyester resin particle dispersion liquid (3) was made to be 0.930.

[Production of Toner 10]

A toner 10 was produced in the same manner as production of the toner 7 except that the amount of the hybrid amorphous polyester resin particle dispersion liquid (3) was changed to be 37 mass parts.

[Production of Toner 11]

A toner 11 was produced in the same manner as production of the toner 6 except that the amount of the hybrid amorphous polyester resin particle dispersion liquid (2) was changed to be 108 mass parts.

[Production of Toner 12]

A toner 12 was produced in the same manner as production of the toner 1 except that the hybrid amorphous polyester resin particle dispersion liquid (1) was changed to the hybrid amorphous polyester resin particle dispersion liquid (4).

[Production of Toner 13]

A toner 13 was produced in the same manner as production of the toner 1 except that an average degree of circularity of the toner mother particle precursor before adding the hybrid amorphous polyester resin particle dispersion liquid (1) was made to be 0.890.

[Production of Toner 14]

A toner 14 was produced in the same manner as production of the toner 1 except that the crystalline polyester resin particle dispersion liquid was removed, and that the rising temperature of 85° C. was changed to the rising temperature of 90° C.

[Production of Toner 15]

A toner 15 was produced in the same manner as production of the toner 1 except that the hybrid amorphous polyester resin particle dispersion liquid (1) was removed.

[Production of Toner 16]

A toner 16 was produced in the same manner as production of the toner 1 except that the hybrid amorphous polyester resin particle dispersion liquid (1) was changed to the vinyl resin particle dispersion liquid (2).

[Production of Toner 17]

A toner 17 was produced in the same manner as production of the toner 1 except that the rising temperature of 85° C. was changed to the rising temperature of 80° C., and that after increasing the particle diameter to be a median diameter of 6.0 μm, 108 mass parts of the hybrid amorphous polyester resin particle dispersion liquid (1) was added over 90 minutes to the toner mother particle precursor having an average degree of circularity of 0.870.

[Production of Toner 18]

A toner 18 was produced in the same manner as production of the toner 1 except that the hybrid amorphous polyester resin particle dispersion liquid (1) was changed to the hybrid amorphous polyester resin particle dispersion liquid (5).

[Production of Toner 19]

A toner 19 was produced in the same manner as production of the toner 1 except that that the hybrid amorphous polyester resin particle dispersion liquid (1) was changed to the amorphous polyester resin particle dispersion liquid (B).

[Production of Toner 20]

A toner 20 was produced in the same manner as production of the toner 1 except that the vinyl resin particle dispersion liquid (1) was changed to 400 mass parts of the amorphous polyester resin particle dispersion liquid (B) and 40 mass parts of the mold release agent particle dispersion liquid.

[Production of Developer]

A ferrite carrier covered with a silicone resin and having a volume-based average particle diameter of 60 μm was added to the toners 1 to 20 so that the content of the toner particles became to be 6 mass %. Thus, there were prepared developers 1 to 20 each respectively containing the toners 1 to 20.

[Surface Shape of Convex Portions]

With respect to the obtained toner mother particles as described above, an average long side length of convex portions, an average distance of convex portions, an average height of convex portions, and an average distribution density of convex portions were measured. The measuring methods were as described above. The measurement results are indicated in the following Table 2.

[Ratio of Absorption Maximum Peak Heights (P2/P1)]

In order to confirm the existing amount (surface CPes amount) of the crystalline polyester resin on the surface of the toner mother particle, the following measurement was done.

An absorption spectrum of the obtained toner as describe above were measured with a total reflection method (ATR method) using a Fourier transform infrared spectroscopic analyzer (Nicolet 380, made by Themo Fisher Co. Ltd.).

The ratio (P2/P1) of the absorption maximum peak height (P1) in the range of 690-710 $cm^{-1}$ and the absorption maximum peak height (P2) in the range of 1190-1220 $cm^{-1}$ was obtained from the absorption spectrum.

Specifically, 0.2 g of toner mother particles was placed in a pellet molder (SSP-10A, made by Shimadzu Co. Ltd.) as a sample. It was pressed with 400 kgf for one minute to prepare a pellet having a diameter of 10 mm.

The ART measurement was done with a diamond crystal under the condition of resolution of 4 $cm^{-1}$, with accumulation times of 32. The obtained ART spectrum was corrected with a correction method of the apparatus, and the value was determined from the peak intensity ratio in the ART corrected spectrum.

[Evaluations]

<Low-Temperature Fixability>

An image forming apparatus "bizhub PRO™ C6500" (made by Konica Minolta, Inc.) was used as an evaluation instrument. The fixing device was modified to be variable in the pressure at a nip area and in the surface temperature of the fixing heat roller in the range of 100 to 210° C. In addition, the processing speed (nip time) was made variable.

The developers produced with the prepared toners were respectively loaded to the image forming apparatus.

The developers produced with the prepared toners each were subjected to the fixing evaluation. A test image having a solid image with a toner adding amount of 8 g/m$^2$ was printed under the conditions of normal-temperature and normal-humidity on an A4 size high quality paper Npi (128 g/m$^2$ made by Nippon Paper Industries Co. Ltd.). The nip pressure of the fixing device was set to be 238 kPa, and the nip time was set to be 25 mm/second (processing speed of 480 mm/s) While the fixing temperature was set from 100° C. to 200° C. with an increment of 5° C., the fixing test was repeated.

Subsequently, each of the printed matters obtained in the fixing test at different temperatures was folded by a folding machine so that the solid image was located on the front side. Then, air compressed at a pressure of 0.35 MPa was blown to the creases in the sample. The condition of the crease was ranked into 5 grades as described in the following evaluation criteria.

Rank 5: No crease is produced.

Rank 4: A partial peel-off is found along the crease.

Rank 3: A narrow linear peel-off is found along the crease.

Rank 2: A bold linear peel-off is found along the crease.

Rank 1: A large peel-off is found in the image.

Among the fixing evaluation results having a rank of 3 or more, the fixing temperature in the lowest fixing temperature test was determined to be a lowest fixing temperature.

When the lowest fixing temperature of the toner is equal to 120° C. or less, it is decided to be excellent. When the lowest fixing temperature of the toner is larger than 120° C. to equal to 125° C. or less, it is decided to be good. When the lowest fixing temperature of the toner is larger than 125° C., it is decided to be no good, and it does not pass the examination.

<Thermal Storage Stability>

A sample of toner (0.5 g) was placed in a 10 mL glass tube having an inner diameter of 21 mm. A cover was put on the sample tube and it was shaken with a shaker "Tapdenser KYT-2000" (made by Seishin Enterprise Co., Ltd.) 600 times at a room temperature. Thereafter, while the cover was taken off, the sample was left at a temperature of 55° C. and a humidity of 35% RH for 2 hours. Then, the toner was put in the sieve of 48 mesh (opening of 350 μm) with precaution of not destructing the toner aggregate. It was set to "a powder tester" (made by Hosokawa Micron Co. Ltd.), and it was fixed with a pressure bar and a knob nut. The vibration intensity was adjusted to have a moving width of 1 mm. After giving vibration for 10 seconds, the remaining amount (mass %) of the toner on the sieves was measured and a toner aggregation ratio was calculated based on the following Scheme (A).

Scheme (A):

$$\text{Toner aggregation ratio (\%)} = [(\text{Remaining mass (g) of the toner on the sieve})/0.5\ (\text{g})] \times 100$$

When the toner aggregation ratio is less than 10 mass %, it is decided to be excellent, and when it is 10 mass % or more to less than 20 mass %, it is decided to be good. When it is 20 mass % or more, it is decided to be no good, and it does not pass the examination.

<Fluidity>

A sample of toner (15 g) was placed in a plastic container (made by As One Co. Ltd.), and the cover was put. The plastic container was shaken with a shaker "Tapdenser KYT-4000" (made by Seishin Enterprise Co., Ltd.) 1800 times at a room temperature. Then, the toner was put in the sieve of 300 mesh (opening of 45 μm) with precaution of not destructing the toner aggregate. Again, the toner sample on the sieve was set in the shaker, and the shaking intensity was set to be level 10 and it was shaken for 2 minutes.

When the amount of the toner passed through the sieve is 12 g or more, it is decided to be excellent, and when it is 9 g or more, it is decided to be good, and they are considered to have no problem for practical use. When it is less than 9 g, it is decided to be no good, and it does not pass the examination.

<Durability>

The toner was loaded in a developing device used in an image forming apparatus "bizhub PRO™ C6501" (made by Konica Minolta, Inc.). The apparatus was driven at a speed of 600 rpm for 3 hours with a single driver. Then, the toner in developing device was sampled. The particle size distribution was measured with "Multisizer 3" (made by Beckman Coulter, Inc.). An increased ratio (mass %) of the toner particles having a diameter of 2.5 μm compared with the toner before placing in the developing device was calculated. When the increased ratio is larger, it indicates that the toner is easily broken in the developing device.

When the increased ratio is 1% or less, it is decided to be excellent, and when it is 3% or less, it is decided to be good. They are decided to be good for practical use. When it is larger than 3%, it is decided to be no good, and it does not pass the examination.

<Fixing Belt Separation Property>

A modified image forming apparatus "bizhub PRO™ C6501" (made by Konica Minolta, Inc.) was used. A recording material "Kanefuji 85 g/m$^2$, T" (Oji Paper Co. Ltd.) was left at a normal-temperature and normal-humidity (temperature of 25° C. and humidity of 50% RH) for one night for humidity conditioning. A test image having a solid image with a toner adding amount of 4.0 g/m$^2$ and a blank space of 8 mm was printed under the conditions of normal-temperature and normal-humidity (temperature of 25° C. and humidity of 50% RH) on this paper with a fixing belt condition having un upper belt of 195° C. and a lower belt of 120° C. The blank space was changed to 7 mm, 6 mm, decreased in 1 mm unit. The test was repeated until the moment of producing jamming of the paper. The smallest blank space that did not produce jamming of the paper was detected. The smaller the blank space, it indicates that the fixing separation property is better.

When the blank space is 3 mm or less, it is decided to be excellent, and when it is 5 mm or less, it is decided to be good. They are decided to pass the examination. When the blank space is larger than 5 mm, it is decided of not passing the examination.

TABLE 1

| | Toner mother particle precursor | | Convex portion | | | Production condition | |
|---|---|---|---|---|---|---|---|
| Toner | Main resin | Amount of crystalline resin (mass parts) | Resin particle dispersion liquid | Hybrid ratio (mass %) | Convex portion resin (mass parts) | Degree of circularity of convex portion resin | Remarks |
| Toner 1 | Dispersion liquid of vinyl resin particles (1) | 45 | Dispersion liquid of hybrid amorphous polyester resin particles (1) | 19.5 | 54 | 0.945 | *1 |
| Toner 2 | Dispersion liquid of vinyl resin particles (1) | 25 | Dispersion liquid of hybrid amorphous polyester resin particles (1) | 19.5 | 54 | 0.945 | *1 |
| Toner 3 | Dispersion liquid of vinyl resin particles (1) | 75 | Dispersion liquid of hybrid amorphous polyester resin particles (1) | 19.5 | 54 | 0.945 | *1 |
| Toner 4 | Dispersion liquid of vinyl resin particles (1) | 15 | Dispersion liquid of hybrid amorphous polyester resin particles (1) | 19.5 | 54 | 0.945 | *1 |
| Toner 5 | Dispersion liquid of vinyl resin particles (1) | 120 | Dispersion liquid of hybrid amorphous polyester resin particles (1) | 19.5 | 54 | 0.945 | *1 |
| Toner 6 | Dispersion liquid of vinyl resin particles (1) | 45 | Dispersion liquid of hybrid amorphous polyester resin particles (2) | 19.5 | 54 | 0.945 | *1 |
| Toner 7 | Dispersion liquid of vinyl resin particles (1) | 45 | Dispersion liquid of hybrid amorphous polyester resin particles (3) | 19.5 | 54 | 0.945 | *1 |
| Toner 8 | Dispersion liquid of vinyl resin particles (1) | 45 | Dispersion liquid of hybrid amorphous polyester resin particles (2) | 19.5 | 54 | 0.960 | *1 |
| Toner 9 | Dispersion liquid of vinyl resin particles (1) | 45 | Dispersion liquid of hybrid amorphous polyester resin particles (3) | 19.5 | 108 | 0.930 | *1 |
| Toner 10 | Dispersion liquid of vinyl resin particles (1) | 45 | Dispersion liquid of hybrid amorphous polyester resin particles (3) | 19.5 | 37 | 0.945 | *1 |
| Toner 11 | Dispersion liquid of vinyl resin particles (1) | 45 | Dispersion liquid of hybrid amorphous polyester resin particles (2) | 19.5 | 108 | 0.945 | *1 |
| Toner 12 | Dispersion liquid of vinyl resin particles (1) | 45 | Dispersion liquid of hybrid amorphous polyester resin particles (4) | 7.7 | 54 | 0.945 | *1 |
| Toner 13 | Dispersion liquid of vinyl resin particles (1) | 45 | Dispersion liquid of hybrid amorphous polyester resin particles (1) | 19.5 | 54 | 0.890 | *1 |
| Toner 14 | Dispersion liquid of vinyl resin particles (1) | 0 | Dispersion liquid of hybrid amorphous polyester resin particles (1) | 19.5 | 54 | 0.890 | *2 |
| Toner 15 | Dispersion liquid of vinyl resin particles (1) | 45 | — | — | — | — | *2 |
| Toner 16 | Dispersion liquid of vinyl resin particles (1) | 45 | Dispersion liquid of vinyl resin particles (2) | — | 54 | 0.945 | *2 |
| Toner 17 | Dispersion liquid of vinyl resin particles (1) | 45 | Dispersion liquid of hybrid amorphous polyester resin particles (1) | 19.5 | 108 | 0.870 | *2 |
| Toner 18 | Dispersion liquid of vinyl resin particles (1) | 45 | Dispersion liquid of hybrid amorphous polyester resin particles (5) | 20.2 | 54 | 0.945 | *2 |
| Toner 19 | Dispersion liquid of vinyl resin particles (1) | 45 | Dispersion liquid of amorphous polyester resin particles (B) | — | 54 | 0.945 | *2 |
| Toner 20 | Dispersion liquid of amorphous polyester resin particles (B) | 45 | Dispersion liquid of hybrid amorphous polyester resin particles (1) | 19.5 | 54 | 0.945 | *2 |

*1: Present invention

*2: Comparison

TABLE 2

| Toner | Surface shape (Convex portion) Long side length (nm) | Distance (nm) | Height (nm) | Distribution density (pieces/μm²) | Surface CPes amount P2/P1 | Performance evaluation Low-temperature fixability (° C.) | Heat resistance (%) | Fluidity (g) | Durability (%) | Separation property (nm) | Remarks |
|---|---|---|---|---|---|---|---|---|---|---|---|
| Toner 1 | 151 | 72 | 61 | 13 | 0.05 | 120 | 7 | 13 | 0 | 1 | Present invention |
| Toner 2 | 133 | 90 | 80 | 11 | 0.05 | 120 | 4 | 14 | 0 | 1 | Present invention |
| Toner 3 | 139 | 85 | 72 | 12 | 0.08 | 120 | 9 | 12 | 0 | 1 | Present invention |
| Toner 4 | 158 | 69 | 69 | 14 | 0.04 | 125 | 3 | 14 | 0 | 1 | Present invention |
| Toner 5 | 170 | 60 | 63 | 16 | 0.17 | 115 | 16 | 9 | 0 | 1 | Present invention |
| Toner 6 | 105 | 58 | 41 | 19 | 0.06 | 120 | 6 | 13 | 0 | 1 | Present invention |
| Toner 7 | 300 | 100 | 120 | 8 | 0.10 | 120 | 8 | 12 | 1 | 1 | Present invention |
| Toner 8 | 92 | 50 | 91 | 21 | 0.12 | 125 | 12 | 11 | 0 | 2 | Present invention |
| Toner 9 | 305 | 20 | 110 | 14 | 0.11 | 125 | 8 | 11 | 2 | 3 | Present invention |
| Toner 10 | 250 | 111 | 111 | 9 | 0.12 | 120 | 15 | 10 | 1 | 0 | Present invention |
| Toner 11 | 118 | 12 | 64 | 25 | 0.05 | 120 | 5 | 13 | 0 | 5 | Present invention |
| Toner 12 | 103 | 71 | 123 | 10 | 0.13 | 125 | 16 | 10 | 2 | 3 | Present invention |
| Toner 13 | 290 | 25 | 43 | 8 | 0.10 | 120 | 10 | 12 | 1 | 3 | Present invention |
| Toner 14 | 150 | 69 | 101 | 13 | 0 | 150 | 4 | 13 | 1 | 1 | Comparison |
| Toner 15 | — | — | — | — | 0.52 | 125 | 60 | 3 | 0 | 1 | Comparison |
| Toner 16 | — | — | — | — | 0.30 | 135 | 25 | 5 | 1 | 8 | Comparison |
| Toner 17 | — | — | — | — | 0.38 | 120 | 40 | 6 | 3 | 8 | Comparison |
| Toner 18 | 184 | 60 | 103 | 6 | 0.37 | 125 | 35 | 6 | 1 | 3 | Comparison |
| Toner 19 | 207 | 66 | 150 | 9 | 0.33 | 120 | 40 | 9 | 5 | 6 | Comparison |
| Toner 20 | 33 | 94 | 20 | 5 | 0.39 | 125 | 24 | 5 | 2 | 2 | Comparison |

From the evaluation results indicated in Table 2, it is confirmed that the toner of the present invention is excellent in low-temperature fixability, heat resistance, durability, and fixing belt separation property compared with the comparative toners.

Specifically, the comparative toners have the following properties.

Toner 14 has no crystalline resin, and it has inferior fixability.

Toner 15 is produced without using a dispersion liquid for convex portion resin particles. It has no convex portion, and a crystalline resin is exposed on the surface of the toner. It has inferior heat resistance and fluidity.

Toner 16 uses a vinyl resin as a convex portion resin. As a result, it has no convex portion. It has inferior fixability and heat resistance. Since the surface of the toner mother particle precursor is completely covered, it has inferior fixing belt separation property.

Toner 17 is produced by adding a dispersion liquid for convex portion resin particles at the moment of having low average degree of circularity. Therefore, it does not form a convex portion, but is forms a structure of almost completely covering the surface of the toner mother particle precursor. As a result, it has inferior fixing belt separation property, and a large amount of the crystalline polyester resin is exposed on the surface.

Toner 18 has a specific resin composition of the convex portion. By this resin composition, the crystalline resin makes compatible blend with the convex portion resin. A large amount of the crystalline polyester resin is exposed on the surface, and it has an inferior fixing belt separation property.

Toner 19 has a convex portion resin that is not hybridized. As a result, the convex portion tends to be detached, and the toner has inferior durability. The crystalline resin makes compatible blend with the convex portion resin. A large amount of the crystalline polyester resin is exposed on the surface, and the toner has an inferior fixing belt separation property.

Toner 20 does not use a vinyl resin for the toner mother particle precursor. As a result, the toner mother particle precursor resin will easily make compatible blend with the convex portion resin. As a result, a large amount of the crystalline polyester resin is exposed on the surface, and the toner has an inferior fixing belt separation property.

What is claimed is:

1. An electrostatic image developing toner comprising toner mother particles, wherein the toner mother particle is formed by being provided with a plurality of convex portions on a toner mother particle precursor;

the toner mother particle precursor contains a vinyl resin, a crystalline resin, and a mold release agent;

the convex portion is formed with a hybrid amorphous polyester resin which is formed with a vinyl type polymerization segment and a polyester type polymerization segment both bonded together; and the hybrid amorphous polyester resin contains constituting units of a bisphenol A-propylene oxide adduct and a bisphenol A-ethylene oxide adduct.

2. The electrostatic image developing toner of claim 1, wherein the crystalline resin is contained in the range of 3 to 20 mass % with respect to the total mass of resins in the toner mother particle.

3. The electrostatic image developing toner of claim 1, wherein the convex portions have an average long side length in the range of 100 to 300 nm.

4. The electrostatic image developing toner of claim 1, wherein the convex portions have an average distance on a surface of the toner mother particle precursor in the range of 20 to 100 nm.

5. The electrostatic image developing toner of claim 1, wherein the crystalline resin is encapsulated in the toner mother particle precursor, and the crystalline resin is not exposed to a surface of the toner mother particle precursor and a surface of the toner mother particle.

6. The electrostatic image developing toner of claim 1, wherein the hybrid amorphous polyester resin contains the vinyl type polymerization segment in the range of 5 to 30 mass %.

7. A method of producing the electrostatic image developing toner of claim 1, the method comprising the steps of:

making the toner mother particle precursor to have an average degree of circularity of 0.890 or more; and forming the convex portion by adhering the hybrid amorphous polyester resin on a surface of the toner mother particle precursor.

* * * * *